US008824941B2

(12) United States Patent
Shimizu et al.

(10) Patent No.: US 8,824,941 B2
(45) Date of Patent: Sep. 2, 2014

(54) IMAGE TRANSFER DEVICE AND IMAGE FORMING APPARATUS INCORPORATING SAME

(71) Applicants: Yasunobu Shimizu, Kanagawa (JP); Tomokazu Takeuchi, Tokyo (JP); Hiroyoshi Haga, Kanagawa (JP); Hiromi Ogiyama, Tokyo (JP); Kenji Sengoku, Kanagawa (JP)

(72) Inventors: Yasunobu Shimizu, Kanagawa (JP); Tomokazu Takeuchi, Tokyo (JP); Hiroyoshi Haga, Kanagawa (JP); Hiromi Ogiyama, Tokyo (JP); Kenji Sengoku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 13/633,341

(22) Filed: Oct. 2, 2012

(65) Prior Publication Data

US 2013/0094870 A1 Apr. 18, 2013

(30) Foreign Application Priority Data

Oct. 14, 2011 (JP) ..... 2011-226597

(51) Int. Cl.
*G03G 15/16* (2006.01)

(52) U.S. Cl.
CPC ..... *G03G 15/1605* (2013.01); *G03G 15/1675* (2013.01)
USPC ..... 399/315; 399/66; 399/88

(58) Field of Classification Search
CPC ..... G03G 15/6535
USPC ..... 399/45, 88, 302, 310, 315; 363/63; 327/415
See application file for complete search history.

(56) References Cited

U.S. PATENT DOCUMENTS

| | | | | |
|---|---|---|---|---|
| 4,190,348 | A * | 2/1980 | Friday | 399/314 |
| 4,528,937 | A | 7/1985 | Kanno et al. | |
| 4,851,874 | A | 7/1989 | Ogiyama | |
| 5,029,840 | A | 7/1991 | Haga et al. | |

(Continued)

FOREIGN PATENT DOCUMENTS

| | | |
|---|---|---|
| JP | 1-229277 | 9/1989 |
| JP | 7-114273 | 5/1995 |
| JP | 2006-267486 | 10/2006 |
| JP | 2008-058585 | 3/2008 |

OTHER PUBLICATIONS

U.S. Appl. No. 13/472,743, filed May 16, 2012, Junpei Fujita, et al.
U.S. Appl. No. 13/472,897, filed May 16, 2012, Hiromi Ogiyama.

(Continued)

*Primary Examiner* — Clayton E Laballe
*Assistant Examiner* — Leon W Rhodes, Jr.
(74) *Attorney, Agent, or Firm* — Oblon, Spivak, McClelland, Maier & Neustadt, L.L.P.

(57) ABSTRACT

An image transfer device includes an image bearing member, a pair of opposed transfer members, a media separator, and an electrical bias applicator. The image bearing member defines an image bearing surface on which a toner image is created. The pair of opposed transfer members is disposed opposite each other via the image bearing member to form a transfer nip therebetween through which a recording medium is passed. One of the transfer members defines a first electrode to which a first electrical bias is applied. The media separator defines a second electrode downstream from the transfer nip to which a second electrical bias is applied. The electrical bias applicator includes a power supply connectable with each of the first and second electrodes to supply the first electrical bias to the first electrode and the second electrical bias to the second electrode.

21 Claims, 12 Drawing Sheets

(56) References Cited

U.S. PATENT DOCUMENTS

| | | | | |
|---|---|---|---|---|
| 5,483,330 | A | 1/1996 | Ogiyama et al. | |
| 5,689,758 | A * | 11/1997 | Wataki et al. | 399/45 |
| 5,991,570 | A | 11/1999 | Haga et al. | |
| 6,314,264 | B1 * | 11/2001 | Iida et al. | 399/302 |
| 7,190,915 | B2 * | 3/2007 | Akizuki et al. | 399/69 |
| 7,957,665 | B2 * | 6/2011 | Day et al. | 399/88 |
| 8,041,249 | B2 * | 10/2011 | Hara | 399/101 |
| 8,116,669 | B2 * | 2/2012 | Sato et al. | 399/315 |
| 2001/0031159 | A1 | 10/2001 | Ogiyama et al. | |
| 2002/0034406 | A1 | 3/2002 | Kawagoe et al. | |
| 2003/0016968 | A1 | 1/2003 | Takahashi et al. | |
| 2003/0026625 | A1 | 2/2003 | Tamiya et al. | |
| 2003/0035660 | A1 | 2/2003 | Sugino et al. | |
| 2003/0118359 | A1 | 6/2003 | Ogiyama et al. | |
| 2003/0219287 | A1 | 11/2003 | Ogiyama et al. | |
| 2004/0105692 | A1 | 6/2004 | Tamiya et al. | |
| 2004/0136760 | A1 | 7/2004 | Yoshida et al. | |
| 2005/0013636 | A1 | 1/2005 | Sawai et al. | |
| 2005/0047816 | A1 | 3/2005 | Uchida et al. | |
| 2005/0147424 | A1 | 7/2005 | Kato et al. | |
| 2006/0127116 | A1 | 6/2006 | Ogiyama et al. | |
| 2007/0134014 | A1 | 6/2007 | Kato et al. | |
| 2007/0258737 | A1 | 11/2007 | Ogiyama et al. | |
| 2008/0232867 | A1 | 9/2008 | Minbu et al. | |
| 2010/0040386 | A1 | 2/2010 | Mizutani et al. | |
| 2010/0080631 | A1 | 4/2010 | Ogiyama et al. | |
| 2010/0098446 | A1 | 4/2010 | Ishikawa et al. | |
| 2010/0142985 | A1 | 6/2010 | Minbe et al. | |
| 2010/0221029 | A1 | 9/2010 | Minbu et al. | |
| 2011/0064487 | A1 | 3/2011 | Ichihashi et al. | |
| 2011/0158690 | A1 | 6/2011 | Mimbu et al. | |
| 2011/0181116 | A1 | 7/2011 | Takeuchi et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0008991 | A1 | 1/2012 | Shimizu | |
| 2012/0045237 | A1 | 2/2012 | Aoki et al. | |
| 2012/0213536 | A1 | 8/2012 | Takeuchi | |
| 2012/0224879 | A1 | 9/2012 | Fujita et al. | |
| 2012/0230715 | A1 | 9/2012 | Ogino et al. | |
| 2012/0237260 | A1 | 9/2012 | Sengoku et al. | |
| 2012/0237271 | A1 | 9/2012 | Sengoku et al. | |

OTHER PUBLICATIONS

U.S. Appl. No. 13/477,724, filed May 22, 2012, Yasunobu Shimizu, et al.
U.S. Appl. No. 13/483,536, filed May 30, 2012, Kenji Sengoku, et al.
U.S. Appl. No. 13/485,151, filed May 31, 2012, Yasunobu Shimizu, et al.
U.S. Appl. No. 13/526,894, filed Jun. 19, 2012, Tomokazu Takeuchi, et al.
U.S. Appl. No. 13/527,153, filed Jun. 19, 2012, Junpei Fujita, et al.
U.S. Appl. No. 13/530,555, filed Jun. 22, 2012, Tomokazu Takeuchi, et al.
U.S. Appl. No. 13/541,211, filed Jul. 3, 2012, Hiromi Ogiyama, et al.

* cited by examiner

IMAGE TRANSFER DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-226597, filed on Oct. 14, 2011, the entire disclosure of which is hereby incorporated by reference herein.

BACKGROUND OF THE INVENTION

1. Technical Field

The present invention relates to an image transfer device and an image forming apparatus incorporating the same, and more particularly, to an image transfer device that transfers a toner image from an image bearing surface to a recording medium, and an electrophotographic image forming apparatus incorporating such an image transfer capability.

2. Background Art

In electrophotographic image forming apparatuses, such as photocopiers, facsimile machines, printers, plotters, or multifunctional machines incorporating several of those imaging functions, an image is created through a sequential imaging process, including electrostatic charging of a photoconductive surface, exposure of the photoconductive surface to light creating an electrostatic latent image on the photoconductor, and development of the latent image into a visible toner image, followed by transferring the toner image to a recording medium, such as a sheet of paper.

Some image forming apparatuses incorporate an intermediate transfer mechanism, a particular type of image transfer process, which includes a looped intermediate transfer belt with its outer, image bearing surface contacting a drum-shaped photoconductor to form a primary transfer nip therebetween, at which the toner image is transferred from the photoconductive surface to the image bearing surface. The mechanism also includes a pair of opposed transfer members, one being a nip roller outside the belt loop and the other being a backup roller inside the belt loop, disposed opposite each other via the belt to form a secondary transfer nip therebetween, at which the toner image is transferred from the image bearing surface to a recording medium entering the nip in sync with the toner image.

Good imaging quality requires proper conveyance of recording media throughout the imaging process. Thus, for facilitating media conveyance through the transfer nip, the image transfer device may be equipped with a media separator that separates the recording medium from the image bearing surface after exiting the transfer nip.

For example, an image transfer device with an electrically biased media separation capability has been proposed that includes a transfer roller disposed opposite an image bearing member to form a transfer nip therebetween across which an electrostatic transfer bias is applied to transfer a toner image from the image bearing member to the recording medium. A media separator electrode in the form of a roller is disposed downstream from the transfer nip in a direction in which the recording medium is conveyed and removes charge from the recording medium to assist in separating the recording medium from the image bearing surface at the exit of the transfer nip.

In this image transfer device, the transfer roller is connected to a transfer power supply that supplies a transfer bias voltage to the transfer roller to enable electrostatic image transfer across the transfer nip. The media separator roller is connected to a separator power supply different from the transfer power supply that supplies a separator bias voltage to the media separator roller to separate the media from the image bearing surface after exiting the transfer nip.

The media separator roller is positioned extremely close to the transfer nip so as to leave a minimum allowable spacing between the media separator roller and the transfer roller. Such positioning is intended to compensate for a relatively low discharge efficiency of the roller-shaped electrode, which has a relatively large radius of curvature, as compared to that of a thin, needle-shaped electrode, and therefore yields a smaller amount of electric charge induced per unit voltage applied.

According to this method, the transfer power supply, dedicated to the transfer roller, performs constant current control as the transfer roller rotates, whereas the media power supply, dedicated to the media separator roller, performs constant current control during passage of a recording medium through the transfer nip. These power supplies are controlled to have their alternating current components oscillating with identical phase and frequency, so as to prevent interference between the bias voltages applied to the transfer roller and the media separator roller.

Two measures may be adopted to improve performance of electrically biased media separation during image transfer: one is to reduce the gap or spacing between the media separator and the transfer nip, and the other is to increase the amount of separator bias voltage applied to the media separator. Of these, increasing the separator bias voltage is less likely to adversely affect proper media conveyance through the transfer nip, considering that too small a roller-to-nip gap can result in undesired interference between the media separator and the recording medium. However, increasing the voltage applied to the media separator has a limitation in that increased electrical biasing to the media separator can induce a substantial potential difference between the media separator and the transfer roller, leading to an electrical interference and an electric field which eventually causes a leakage current between the media separator and the transfer roller.

Current leakage between the media separator and the transfer roller would cause various adverse effects, such as unwanted adhesion of toner to the transfer roller and the media separator, resulting in soiling or smudges on the back of the recording medium as well as contamination of the surrounding structure inside the imaging equipment. Moreover, increased amounts of leakage current generate significant amounts of ozone through electrical discharge, while disturbing a balance between the current flow from the transfer roller toward the image bearing surface and that from the media separator toward the image bearing surface, resulting in imperfect image transfer and unintended re-transfer of toner from the recording medium to the image bearing surface due to excessive electrical discharge from the media separator.

One possible approach to address the problem is to adjust electrical biases applied to the transfer roller and the media separator from their respective power supplies, such that a change in the separator bias voltage is followed by a corresponding change in the transfer bias voltage. Such adjustment allows for maintaining the transfer bias and the media separator bias equal to each other, which reduces the risk of a large potential difference and concomitant current leakage between the media separator and the transfer roller.

Although theoretically effective, this approach is impractical, however. Adjustment of the transfer bias and separator bias voltages would require complicated feedback control circuitry that initially measures the voltage supplied to the media separator, and then tunes the voltage supplied to the transfer member to be equal to the measured voltage. Moreover, provision of separate, dedicated voltage sources for the transfer roller and the media separator results in a relatively large electrical bias applicator, which adds to overall size and costs of the image forming apparatus incorporating the image transfer device.

SUMMARY OF THE INVENTION

Exemplary aspects of the present invention are put forward in view of the above-described circumstances, and provide a novel image transfer device.

In one exemplary embodiment, the image transfer device includes an image bearing member, a pair of opposed transfer members, a media separator, and an electrical bias applicator. The image bearing member defines an image bearing surface on which a toner image is created. The pair of opposed transfer members is disposed opposite each other via the image bearing member to form a transfer nip therebetween through which a recording medium is passed. One of the transfer members defining a first electrode to which a first electrical bias is applied to electrostatically transfer the toner image from the image bearing surface to the recording medium across the transfer nip. The media separator defines a second electrode downstream from the transfer nip to which a second electrical bias is applied to separate the recording medium from the image bearing surface after exiting the transfer nip. The electrical bias applicator includes a power supply connectable with each of the first and second electrodes to supply the first electrical bias to the first electrode and the second electrical bias to the second electrode.

Further exemplary aspects of the present invention are put forward in view of the above-described circumstances, and provide a novel image forming apparatus incorporating an image transfer device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
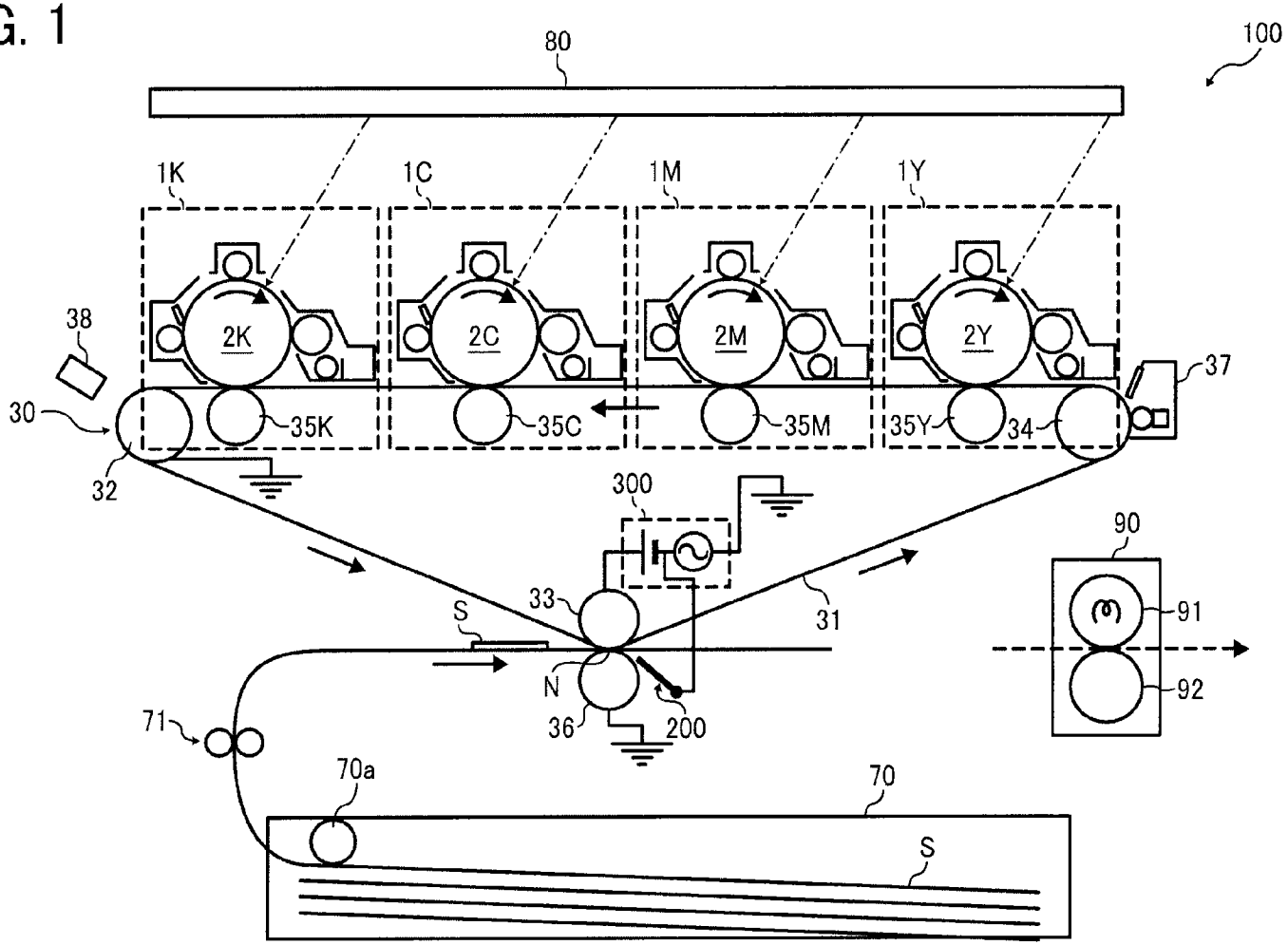
FIG. 1 schematically illustrates an image forming apparatus according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 according to one or more embodiments of this patent specification.

As shown in FIG. 1, the image forming apparatus 100 comprises an electrophotographic color printer, consisting of a plurality of electrophotographic imaging units 1Y, 1M, 1C, and 1K (collectively referred to as "imaging units 1") for forming primary images with toner particles of particular primary colors. The four imaging units 1Y, 1M, 1C, and 1K have a substantially identical configuration except for the color of toner used in image formation, as designated by the suffixes "Y" for yellow, "M" for magenta, "C" for cyan, and "K" for black. These suffix letters are used to distinguish corresponding components of the imaging units, and can be occasionally omitted where the description is applicable to all the imaging units or to those corresponding components.

Each imaging unit 1 includes a drum-shaped photoconductor 2 rotatable clockwise in the drawing, defining an outer, photoconductive image bearing surface surrounded by various pieces of imaging equipment which work in cooperation with each other to create a primary toner image on the photoconductive surface.

Disposed above the imaging units 1 is an exposure unit 80 incorporating an optical scanner that irradiates the photoconductive surface with light for forming an electrostatic latent image on the photoconductive surface. The exposure unit 80 includes a light source, such as a light-emitting diode (LED) or an LED array formed of multiple LED elements, to generate a laser beam modulated according to image data, and a motor-driven polygon mirror to optically scan the photoconductive surface with the laser beam.

Figure 2:
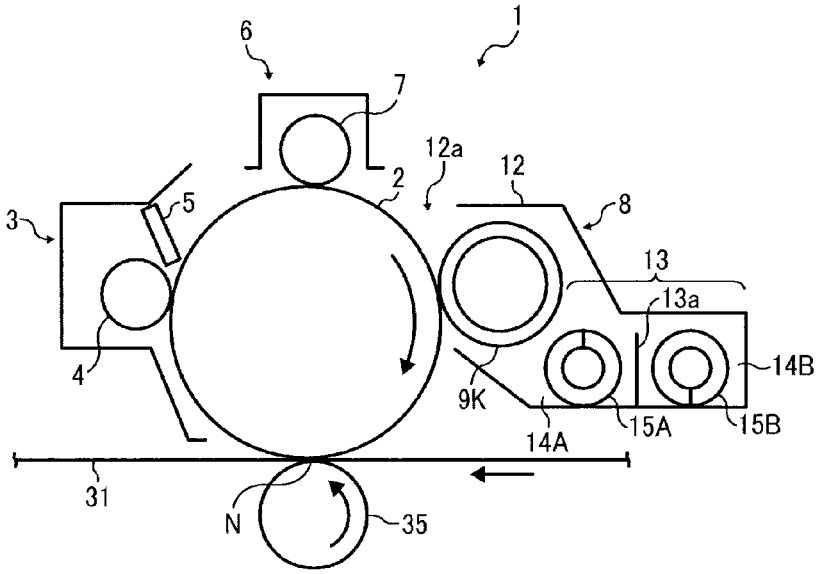
FIG. 2 is a an end-on, axial view of an imaging unit included in the image forming apparatus of FIG. 1.

With additional reference to FIG. 2, the imaging unit 1 is shown including a charging device 6, a development device 8, a drum cleaner 3 disposed around the photoconductor drum 2. In addition to those specifically described in the drawing, other elements, such as a discharging device, may also be included. Components of the imaging unit 1 are replaceable as needed, for example, at the end of their useful life, and are assembled together into a single, integral unit in a suitable support or enclosure removably installed in the image forming apparatus 100.

In the imaging unit 1, the photoconductor 2 comprises a drum-shaped body approximately 60 mm in diameter, consisting of a cylindrical substrate on which a coating of organic photoconductor is deposited to form an outer, photoconductive surface.

The charging device 6 includes an electrically biased contact roller 7 formed of a cylindrical core of metal covered by an outer layer of elastic conductive material, disposed adjacent to or in contact with the photoconductor 2. The charging roller 7 is supplied with a suitable electrical bias, such as one created by superimposing an alternating current voltage on a direct current voltage. Alternatively, instead of an electrically biased member 7 disposed adjacent to or in contact with the photoconductor 2, the charging device 6 may be a corona charger or other suitable charging mechanism.

The development device 8 includes an enclosure housing defining a generally upper, applicator part 12 in which a developer applicator 9 is disposed facing the photoconductor 2 via an opening 12*a*, and a generally lower, container part 13 within which developer formed of a mixture of magnetic carrier and negatively chargeable toner particles is accommodated.

In the applicator part 12, the developer applicator 9 extends parallel to and adjacent to the photoconductor 2 for drawing the developer from the container part 13 for subsequent application to the photoconductive surface. The developer applicator 9 is formed of a rotatably driven, tubular nonmagnetic sleeve within which a stationary magnet roll is non-rotatably mounted and affixed.

The container part 13 is divided by a partition 13*a* into a pair of first and second compartments 14A and 14B, with a pair of openings defined in opposed longitudinal ends of the partition 13*a* through which the first and second compartments 14A and 14B communicate with each other.

A pair of rotatably driven, first and second screw conveyors 15A and 15B is disposed within the container part 13, the former disposed in the first compartment 14A and the latter disposed in the second compartment 14B, parallel to the length of the developer applicator 12. Each screw conveyor 15 is formed of a shaft having its two opposed longitudinal ends rotatably supported by a pair of bearings, and a helical blade extending radially from the shaft.

Although not visible in FIG. 2, a toner concentration sensor is disposed at a wall of the second compartment 14B for measuring a concentration of toner in the developer. Measurement of toner concentration may be performed using a permeameter which measures an electromagnetic permeability of material, where the toner concentration in the developer is correlated with and therefore represented by the permeability of the two component developer formed of toner and magnetic carrier.

Readings of the toner concentration sensor are transmitted to a feedback controller included in control circuitry of the image forming apparatus 100, such as a central processing unit (CPU) and its associated memory devices, which controls operation of a toner supply mechanism that supplies new toner to the second compartment 14B of the development device 8 of each imaging unit 1.

Upon receiving a voltage signal representing a measured toner concentration from the toner concentration sensor, the controller compares the incoming signal with a reference signal representing a target toner concentration. Where a difference between the sensor output signal and the reference signal exceeds a threshold value, the controller activates the toner supply mechanism for a period of time proportional to the detected difference, which then delivers a corresponding amount of new toner into the second compartment 14B, thereby regulating the toner concentration to the targeted value.

The drum cleaner 3 may be a combination of different types of cleaning members, such as a motor-driven brush roller 4 rotating against the photoconductor 2 to scrub off toner residues, and a cantilevered cleaning blade 5 with its free end in contact with the photoconductor 2 and pointing opposite a direction in which the photoconductive surface moves to scrape toner residues.

Referring back to FIG. 1, located below the imaging units 1 is an image transfer unit 30 including an endless, intermediate transfer belt 31 disposed adjacent to the photoconductor drums 2 to define an outer, image bearing surface onto which primary toner images are transferred from the photoconductive surfaces to create a composite, secondary toner image thereon.

The intermediate transfer belt 31 is entrained around multiple rollers, including an electrically grounded, motor-driven roller 32 and a cleaning backup roller 34, with a rotary driver provided to the roller 32 which rotate the roller 32 in a rotational direction counterclockwise in the drawing to in turn rotate the belt 31 in the same rotational direction.

The intermediate transfer belt 31 comprises an endless belt of a suitable material, such as carbon-dispersed polyimide resin, having a thickness ranging from 20 μm to 200 μm, preferably approximately 60 μm, and a volume resistivity ranging from $10^6$Ω•cm to $10^{12}$Ω•cm, preferably, approximately $10^9$Ω•cm, as measured using a voltage of 100 V with a resistivity meter model Hiresta UP MCP HT45 (manufactured by Mitsubishi Chemical Analytech Co., Ltd.).

Also included in the image transfer unit 30 are four primary transfer rollers 35Y, 35M, 35C, and 35K each disposed opposite an associated one of the photoconductive drums 2Y, 2M, 2C, and 2K via the intermediate transfer belt 31 to form primary transfer nips therebetween, and a pair of secondary transfer members, one being a backup roller 33 facing a surface opposite the image bearing surface of the belt 31, and the other being a nip roller 36 facing the image bearing surface of the belt 31, disposed opposite each other via the intermediate transfer belt 31 to form a secondary transfer nip N therebetween.

Each of the four primary transfer rollers 35Y, 35M, 35C, and 35K is supplied with an electrical, primary transfer bias to establish an electrostatic field under which toner particles are electrostatically transferred from the photoconductor 2 toward the belt 31 across the primary transfer nip. At least one of the opposed transfer members 33 and 36 is supplied with an electrical, secondary transfer bias to establish an electrostatic field under which toner particles are electrostatically transferred from the belt 31 toward a recording sheet S across the secondary transfer nip N.

Specifically, each of the primary transfer rollers 35 comprises an elastic roller formed of a cylindrical core of metal onto which an outer layer of sponged material is layered and bonded. Alternatively, instead of an elastic roller, the primary transfer device may be configured in the form of a brush or other forms of charging devices. Each primary transfer roller 35 is equipped with a suitable bias applicator to apply a constant-current controlled, electrical primary transfer bias to the metal core of the roller 35.

For example, the primary transfer roller 35 may be an elastic roller dimensioned approximately 16 mm in outer diameter, with the diameter of the metal core being approximately 10 mm. The outer layer of the roller 35 exhibits a resistance of approximately $3*10^7$Ω, as calculated using Ohm's law, R=V/I, under a measurement condition where an electric current flows through the sponge layer upon application of a voltage of 1,000 V to the metal core with an electrically grounded 30-mm diameter roller pressed against the sponge layer with a pressure of 10 N.

The secondary transfer backup roller 33 comprises an elastic roller formed of a cylindrical core of metal onto which an outer layer of conductive rubber, such as nitrile butadiene rubber (NBR), is layered and bonded.

For example, the backup roller 33 may be an elastic roller dimensioned approximately 24 mm in outer diameter, with the diameter of the metal core being approximately 16 mm. The outer layer of the roller 33 exhibits a resistance ranging from $10^6\Omega$ to $10^{12}\Omega$, preferably approximately $4*10^7\Omega$, as calculated using Ohm's law under a measurement condition similar to that described above for the primary transfer roller 35.

The secondary transfer nip roller 36 comprises an elastic roller formed of a cylindrical core of metal onto which an outer layer of conductive rubber, such as nitrile butadiene rubber (NBR), is layered and bonded.

For example, the nip roller 36 may be an elastic roller dimensioned approximately 24 mm in outer diameter, with the diameter of the metal core being approximately 14 mm. The outer layer of the roller 36 exhibits a resistance not exceeding $10^6\Omega$, as calculated using Ohm's law under a measurement condition similar to that described above for the primary transfer roller 35.

A displaceable positioning plate may be provided, which retains three primary transfer rollers 35Y, 35M, and 35C in contact with the associated photoconductor drums 2Y, 2M, and 2C, such that the outer surface of the intermediate transfer belt 31 is pressed against the photoconductors 2Y, 2M, and 2C. Where monochrome printing is intended, the positioning plate moves inward from the belt loop to position the rollers 35Y, 35M, and 35C away from the associated photoconductor drums 2Y, 2M, and 2C, such that the outer surface of the intermediate transfer belt 31 separates from the photoconductors 2Y, 2M, and 2C. With the three primary transfer nips thus de-established or removed, the black imaging unit 1K is activated to form a monochrome, black toner image on the image bearing surface of the belt 31.

Optionally, a belt cleaner 37 and a potential sensor 38 may be provided outside the loop of the intermediate transfer belt 31. The belt cleaner 37 comprises a suitable cleaning member disposed in contact with that portion of the belt 31 internally supported by the cleaning backup roller 34 for cleaning the image bearing surface of the belt 31 after secondary image transfer. The potential sensor 38 comprises a suitable surface potential sensor, such as a commercially available surface potential sensor model EFS-22D (manufactured by TDK Corporation), disposed opposite that portion of the belt 31 internally supported by the motor-driven roller 32, with a sensor probe thereof located approximately 4 mm away from the image bearing surface of the belt 31 for measuring an electrical potential at the surface of a toner image created thereon.

Disposed below the image transfer unit 30 is a sheet cassette 70 accommodating a stack of recording media, such as sheets of paper S. A feed roller 70*a* is disposed in contact with an uppermost sheet of the sheet stack at an outlet of the sheet cassette 70 to feed the sheets S one by one into a sheet conveyance path defined by multiple conveyance members, such a pair of registration rollers 71, along which the fed sheet S is conveyed from the sheet cassette 70 toward the secondary transfer nip N.

A fixing device 90 is disposed downstream from the secondary transfer nip N along the sheet conveyance path, including a pair of opposed fixing members, one being a fuser roller 91 equipped with an internal heat source, such as a halogen heater, and the other being a pressure roller 92 pressing against the fuser roller 91 while rotating in a rotational direction clockwise in the drawing, to form a fixing nip therebetween through which a recording sheet S is conveyed to fix a toner image in place with heat and pressure.

In the present embodiment, the image forming apparatus 100 incorporates a negative toner system in which toner particles are normally charged to a negative polarity for developing an electrostatic latent image created by selectively dissipating charge on a negatively charged photoconductive surface. Negatively charged toner particles may be transferred, for example, across the secondary transfer nip N by biasing the backup roller 33 to a negative polarity or by biasing the nip roller 36 to a positive polarity. However, the polarities to which toner and electrically chargeable elements of the image forming apparatus may be other than those depicted in the present embodiment and any suitable type of toner and charge polarity may be used depending specific applications.

During operation, each of the four imaging units 1 rotates the photoconductive drum 2 clockwise in the drawing, so as to advance its photoconductive surface sequentially through charging, exposure, development, primary transfer, and cleaning in a single rotation of the photoconductive drum 2.

First, in the charging device 6, the charging roller 7 is supplied with an AC-DC superimposed bias voltage to generate an electric discharge between the charging roller 7 and the photoconductor 2, such that the photoconductive surface entering the charging device 6 is uniformly charged to a negative polarity, which is the polarity to which toner particles are charged.

In the exposure unit 80, the light source generates a laser beam modulated according to image data, which may be transmitted from an external device, such as a personal computer, to the image forming apparatus 100. The laser beam thus emitted reflects upon multiple facets of the rotating polygon mirror, which directs the incoming light toward the photoconductor drum 2 while deflecting it in a main scanning direction over the photoconductive surface.

The photoconductive surface after charging is subsequently exposed to the laser beam from the exposure unit 80. The laser exposure selectively dissipates the charge on the photoconductive surface, such that those areas of the photoconductive surface exposed to light exhibits a reduced, lower potential than that of the other, non-irradiated areas, resulting in an electrostatic latent image formed on the photoconductor 2 according to image data representing a particular primary color.

Then, the latent image enters the development device 8. In the development device 8, the screw conveyors 15A and 15B rotate in their predetermined rotational directions, so that the developer flows from one end to another of the first compartment 14A in one axial direction (toward the viewer in FIG. 2), exiting the first compartment 15A to enter the second compartment 15B through the opening in the partition 13*a*, and then flows from one end to another of the second compartment 14B in another, opposite axial direction (away from the viewer in FIG. 2).

As the developer travels in the first compartment 14A, the developer applicator 9 attracts part of the developer onto the surface of the nonmagnetic sleeve with a magnetic force exerted by the magnet roll. Toner thus carried on the applicator sleeve enters a gap defined between the photoconductor 2 and the developer applicator 9 as the sleeve rotates in a rotational direction opposite that of the photoconductor drum 2.

The applicator sleeve is electrically biased with a development bias voltage that has a polarity identical that of toner charge and having an amplitude greater than that of charge on the electrostatic latent image on the photoconductor 2 and smaller than that of charge on the background, non-image area of the photoconductive surface.

Such electrical biasing creates a positive potential difference between the applicator sleeve and the electrostatic latent image to drive toner particles from the applicator sleeve toward the electrostatic latent image, as well as an opposite, negative potential difference between the applicator sleeve and the non-image area of the photoconductive surface to hold toner particles in position on the applicator sleeve. Under the effects of the opposed potential differences, toner is supplied to the electrostatic latent image on the photoconductive surface to render it into a visible, toner image.

After exiting the development device 8, the photoconductive surface is forwarded to the primary transfer nip between the photoconductor 2 and the primary transfer roller 35, at which the toner image is transferred from the photoconductive surface to the intermediate transfer belt 31 under the primary transfer bias and pressure applied between the photoconductor 2 and the primary transfer roller 35. Such primary transfer takes place as the intermediate transfer belt 31 passes through the four primary transfer nips sequentially, so that the yellow, magenta, cyan, and black toner images are superimposed one upon another to form a composite, multicolor toner image on the belt 31.

Thereafter, the drum cleaner 3 removes residual toner remaining on the photoconductive surface after primary image transfer, followed by the discharging device removing residual charge on the photoconductor 2, which restores the photoconductive surface to a clean, initialized state in preparation for a subsequent imaging cycle.

Then, the toner image created on the image bearing surface of the belt 31 enters a measurement gap defined between the potential sensor 38 and the image bearing surface of the belt 31, upon which the potential sensor 38 measures an electrical potential of the incoming toner image. After measurement, the toner image is directed to the secondary transfer nip N between the secondary transfer rollers 33 and 36.

Meanwhile, in the sheet cassette 70, the feed roller 70*a* picks up a recording sheet S from atop the sheet stack, and introduces it between the pair of registration rollers 71 being rotated. Upon receiving the incoming sheet S, the registration rollers 71 stop rotation to hold the sheet S therebetween, and then advance it in sync with the movement of the intermediate transfer belt 31 to the secondary transfer nip N.

At the secondary transfer nip N, the toner image travelling on the intermediate transfer belt 31 is transferred from the image bearing surface of the belt 31 to the recording sheet S under the secondary transfer bias and pressure applied between the secondary transfer rollers 33 and 36. Upon completion of secondary transfer, the multicolor image is reproduced with a full range of colors as it appears on a white or opaque background of the recording sheet S.

As the recording sheet S exits the secondary transfer nip N, curvature of the secondary transfer rollers 33 and 36 causes the sheet S to separate from the adjoining surfaces of the belt 31 and the roller 36. The belt 31 after secondary transfer is advanced to the belt cleaner 37, which removes toner residues untransferred and remaining on the belt surface for a subsequent imaging cycle.

The recording sheet S onto which the powder toner image is transferred enters the fixing device 90, at which heat and pressure across the fixing nip causes the toner particles to melt and fuse on the recording sheet S, resulting in a complete toner image fixed in place on the recording sheet S. After exiting the fixing unit 90, the recording sheet S is introduced into a post-fixing conveyance path to be eventually delivered to an output tray outside the apparatus body.

With continued reference to FIG. 1, specific configurations of the image transfer device 30 incorporated in the image forming apparatus 100 are described in greater detail.

As shown in FIG. 1, and as mentioned earlier, the image transfer unit 30 has the intermediate transfer belt 31 entrained around the motor-driven roller 32, the transfer backup roller 33, the cleaning backup roller 34, and the four primary transfer rollers 35Y, 35M, 35C, and 35K, with the nip roller 36, the belt cleaner 37, and the potential sensor 38 disposed outside the loop of the belt 31.

In addition to the intermediate transfer belt 31 and the pair of opposed transfer members 33 and 36, the image transfer unit 30 includes a sheet separator 200 disposed downstream from the secondary transfer nip N adjacent to the nip roller 36 outside the loop of the intermediate transfer belt 31, and an electrical bias applicator 300 disposed at a suitable location within the image forming apparatus 100.

The sheet separator 200 comprises a discharge electrode, such as a conductive needle with a sawtoothed edge, to which a high bias voltage, comparable to that applied to the secondary transfer member, is applied to separate or assist in separating the recording sheet S from the image bearing surface after exiting the transfer nip N.

The electrical bias applicator 300 includes a suitable power supply, which may be an alternating current (AC) power supply for generating an AC voltage or current, a direct current (DC) power supply for generating a DC voltage or current, or a combination of both. Either or each of the opposed transfer rollers 33 and 36 has its conductive, metal core connected to an output terminal of the power supply of the applicator 300, which constitutes an electrode to which an electrical bias is applied to cause electrostatic transfer of a toner image across the transfer nip N.

In the present embodiment, for example, the electrical bias applicator 300 includes a combination of AC power supply and a DC power supply, which together create a transfer bias voltage, or potential difference, consisting of an AC voltage superimposed on a DC voltage between the opposed transfer rollers 33 and 36. The AC voltage generated by the AC power supply may have a sinusoidal waveform, a rectangular waveform, or any other suitable waveform.

The AC and DC power supplies are connected in series with the metal core of the backup roller 33, so as to apply an AC-DC superimposed bias voltage to the metal core of the backup roller 33, with the metal core of the nip roller 36 being electrically grounded. In such cases, the DC component of the bias voltage applied to the backup roller 33 is of a polarity identical to that of charged toner particles, so as to yield a time-average potential of the bias voltage polarized to the polarity of toner charge.

Alternatively, instead, the AC and DC power supplies may be connected in series with the metal core of the nip roller 36, so as to apply an AC-DC superimposed bias voltage to the metal core of the nip roller 36, with the metal core of the backup roller 33 being electrically grounded. In such cases, the DC component of the bias voltage applied to the nip roller 36 is of a polarity opposite to that of charged toner particles, so as to yield a time-average potential of the bias voltage polarized opposite the polarity of toner charge.

Further, instead of applying an AC-DC superimposed, composite bias voltage to a single transfer member, the bias applicator 300 may be configured to separately apply a DC voltage to one of the opposed transfer members 33 and 36 and an AC voltage to the other one of the opposed transfer members 33 and 36.

Furthermore, the bias applicator 300 may be configured to selectively apply a DC bias voltage or an AC-DC superimposed bias voltage depending on the type of recording sheet S in use. For example, where printing is performed using smooth paper, such as a normal copy sheet, the bias applicator 300 applies a DC bias voltage. Contrarily, where printing is performed using rough paper with a coarse, irregular texture, which is susceptible to variations in image density, the bias applicator 300 applies an AC-DC superimposed bias voltage for enabling uniform distribution of toner particles over the paper surface.

As used herein, the term "transfer bias" refers to a voltage, current, or combination thereof applied to an electrode defined by a transfer member to electrostatically transfer the toner image from the image bearing surface to the recording medium across the transfer nip. In particular, the term "transfer bias voltage" may be used to collectively describe a combination of an AC voltage and a DC voltage, which are applied either separately or as a single composite voltage to create a potential difference across the transfer nip.

In the following discussion, the transfer bias voltage applied between a pair of opposed transfer members is expressed as a positive or negative, relative potential difference between one transfer member and the other transfer member.

For example, where the transfer nip N is formed by the pair of opposed transfer rollers 33 and 36, the transfer bias voltage is obtained by subtracting the potential at the metal core of the nip roller 36 from the potential at the metal core of the backup roller 33. In particular, where the metal core of the backup roller 33 is connected to the power supply and the metal core of the nip roller 36 is electrically grounded, the potential at the metal core of the backup roller 33 represents a relative potential difference between the metal cores of the opposed rollers 33 and 36.

In such cases, for proper electrostatic transfer of a toner image from the backup roller 33 toward the nip roller 36 across the transfer nip N, the transfer bias voltage is adjusted such that the time average of the potential difference is of a polarity identical to that of charged toner particles (that is, a negative polarity where negatively chargeable toner is used), causing the nip roller 36 to be more polarized to a polarity opposite the toner polarity than is the backup roller 33.

Also, the amplitude of transfer bias voltage may be represented in terms of an offset voltage (i.e., an amplitude of the DC component of the transfer bias) and a peak-to-peak voltage (i.e., a peak-to-peak amplitude of the AC component of the transfer bias). Where the transfer bias voltage is created by superimposing an AC voltage on a DC voltage, the time average of such an AC-DC superimposed voltage equals the offset voltage. Specific values of the offset voltage and the peak-to-peak voltage, which constitute the DC and AC components of the transfer bias voltage, respectively, may be selected to satisfy the following inequality:

$$Vpp/4 > |V\text{off}| \quad (1)$$

Figure 3:
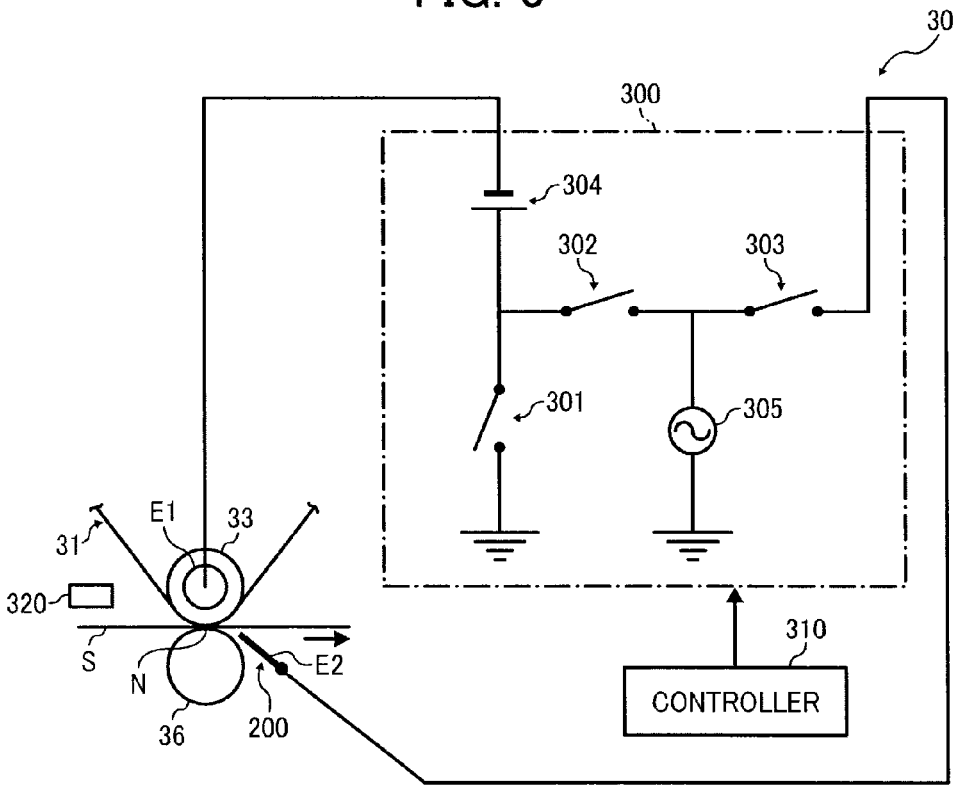
FIG. 3 is a partial view of the image transfer device according to a first embodiment of this patent specification.

FIG. 3 is a partial view of the image transfer device 30 according to a first embodiment of this patent specification.

As shown in FIG. 3, the image transfer device 30 comprises an intermediate transfer mechanism, including an intermediate transfer belt 31 defining an image bearing surface on which a toner image is created, and a pair of opposed transfer members, one being a backup roller 33 contacting a surface opposite the image bearing surface of the belt 31 and the other being a nip roller 36 contacting the image bearing surface of the belt 31, disposed opposite each other via the belt 31 to form a transfer nip N therebetween through which a recording sheet S is passed. The metal core of the backup roller 33 defines a first electrode E1 to which a first electrical bias is applied to electrostatically transfer the toner image from the image bearing surface to the recording sheet S across the transfer nip N.

The image transfer device 30 also includes a sheet separator 200 and an electrical bias applicator 300. The sheet separator 200, being a discharge needle with a sawtoothed edge, defines a second electrode E2 downstream from the transfer nip N to which a second electrical bias is applied to separate the recording medium S from the image bearing surface after exiting the transfer nip N. The electrical bias applicator 300 includes a power supply connectable with each of the first and second electrodes E1 and E2 to supply the first electrical bias to the first electrode E1 and the second electrical bias to the second electrode E2.

Specifically, in the present embodiment, the power supply of the bias applicator 300 includes an AC power supply 305 connectable with each of the first and second electrodes E1 and E2 to generate an alternating current power for supply to the connected electrode, and a DC power supply 304 connectable in series with the first electrode E1 and the AC power supply 305 to generate a direct current power for supply to the first electrode E1. A switching circuit, consisting of first through third switches 301 through 303, is provided to selectively connect each of the DC power supply 304 and the AC power supply 305 to one of the first and second electrodes E1 and E2.

The DC power supply 304 has a negative terminal thereof connected to the electrode E1 of the backup roller 33 and a positive terminal thereof grounded via the first switch 301. The AC power supply 305 has one terminal thereof grounded, and another terminal thereof connected to the positive terminal of the DC power supply 304 via the second switch 302 and to the electrode E2 of the sheet separator 200 via the third switch 303.

The direct current power from the DC power supply 304 is a constant DC voltage and the alternating current power from the AC power supply 305 is an AC voltage. The AC voltage generated by the AC power supply 305 has a peak-to-peak amplitude ranging from 5 to 20 kV, preferably, from 8 to 15 kV, and a frequency ranging from 200 to 2,000 Hz, preferably, from 500 to 1,500 Hz. The DC voltage generated by the DC power supply 304 has an offset amplitude within a suitable range of, for example, from 0 to −5 kV, as dictated by Equation 1. For example, the AC power supply 305 may supply an AC voltage with a peak-to-peak amplitude of approximately 10 kV and a frequency of approximately 500 Hz, and the DC power supply 304 may supply a DC voltage with an offset amplitude of approximately −2 kV.

Figure 4A:
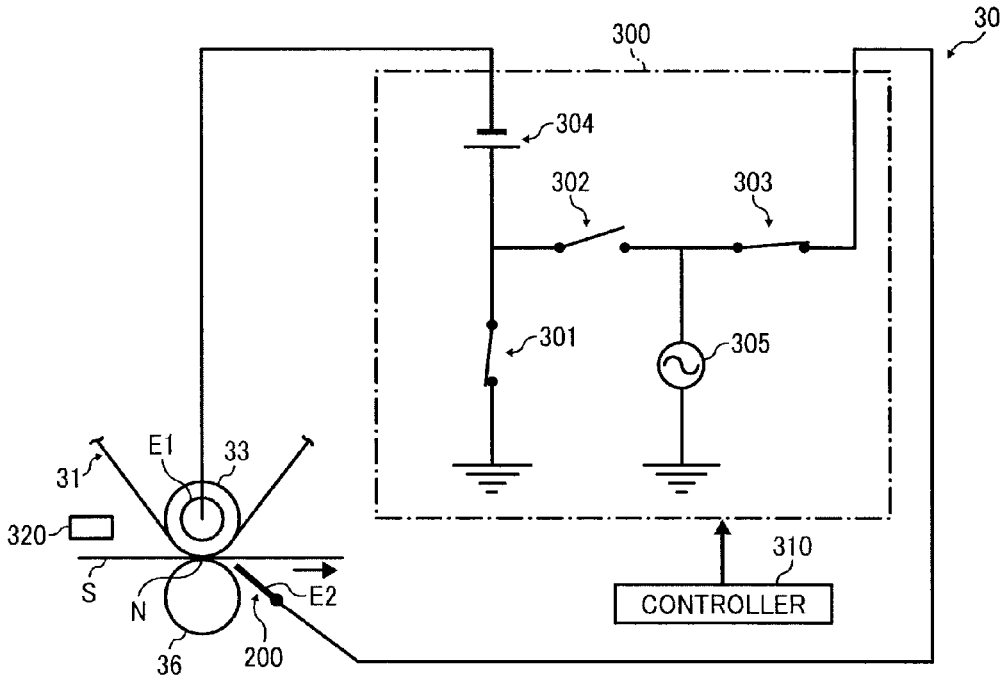
FIGS. 4A and 4B are further views of the image transfer device of FIG. 3.
Figure 4B:
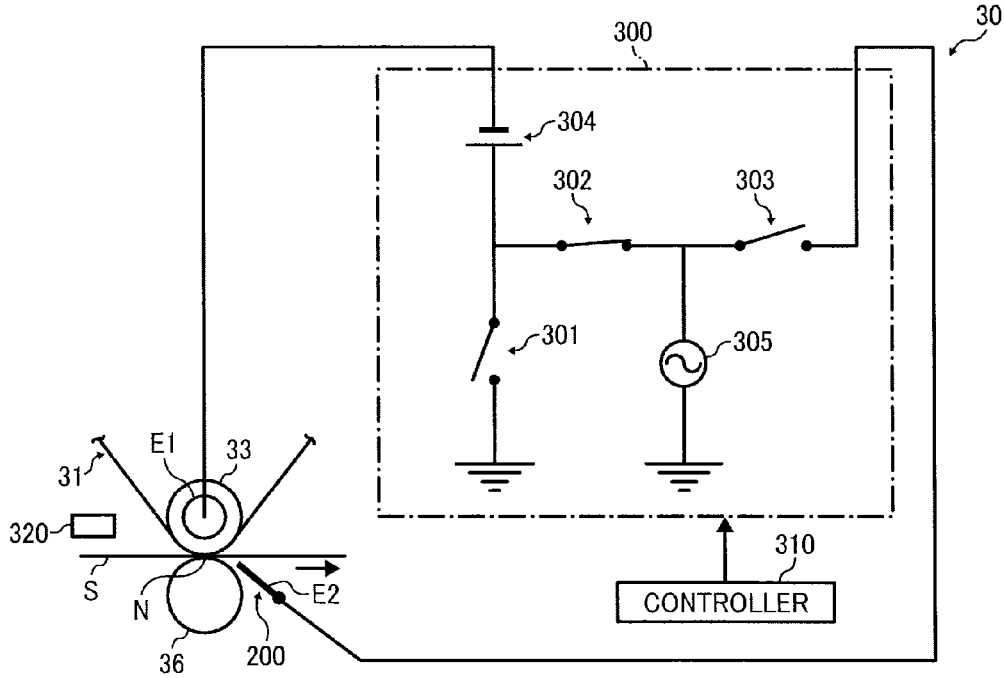

With additional reference to FIGS. 4A and 4B, the bias applicator 300 is shown including a controller 310, such as a central processing unit (CPU) and its associated memory devices, operatively connected to the switching circuit to control the switching circuit. The controller 310 controls operation of the first and second switches 301 and 302 to selectively apply either the direct current power, or a combination of the direct current and the alternating current power to the first electrode E1. Also, the controller 310 controls operation of the third switch 303 to selectively apply the alternating current power to either one of the first and second electrodes E1 and E2.

For example, as shown in FIG. 4A, to apply the direct current power to the first electrode E1, the controller 310 closes the first and third switches 301 and 303 while opening the second switch 302 to connect the DC power supply 304 with the first electrode E1 and the AC power supply 305 with the second electrode E2, resulting in a DC voltage supplied to the first electrode E1 and an AC voltage supplied to the second electrode E2. With the nip roller 36 at a ground potential, the first electrode E1 of the backup roller 33 thus energized by the DC power supply 304 creates a DC-only transfer bias across the transfer nip N between the opposed transfer members 33 and 36.

Conversely, as shown in FIG. 4B, to apply a combination of the direct current power and the alternating current power to the first electrode E1, the controller 310 opens the first and third switches 301 and 303 while closing the second switch 302 to connect the DC power supply 304 and the AC power supply 305 in series with the first electrode E1, resulting in AC and DC voltages supplied together to the first electrode E1 and no voltage supplied to the second electrode E2. With the nip roller 36 at a ground potential, the first electrode E1 of the backup roller 33 thus energized by the DC power supply 304 and the AC power supply 305 creates an AC-DC superimposed transfer bias across the transfer nip N between the opposed transfer members 33 and 36.

Further, the controller 310 controls selective application of the electrical biases (that is, selection between a DC voltage or an AC-DC superimposed voltage to be applied across the transfer nip N) depending on the type of recording medium S in use.

For example, the controller 310 controls selective application of the electrical biases depending on surface smoothness or roughness being a measure of irregularities present on the surface of a recording sheet S. In such cases, the controller 310 may be connected to an optical, recording medium detector 320 disposed upstream from the transfer nip N to detect the type of recording medium in use, as shown in FIG. 3. The sensor 320 measures the smoothness of a recording medium S being conveyed for output to the controller 310, which in turn selects an appropriate bias voltage, such as a DC voltage for normal copy paper and an AC-DC voltage for rough paper.

Alternatively, instead, selective application of the electrical biases may be performed according to an input from a user, who selects a desired bias voltage to be used for a specific print job and submits it to the controller 310 through a suitable user interface.

Hence, the image transfer device 30 according to the first embodiment of this patent specification provides reliable electrostatic image transfer and media separation performance, wherein the bias applicator 300 with its power supply connectable with each of the first and second electrodes E1 and E2 prevents current leakage due to a phase difference between AC voltages simultaneously applied to the transfer member and the media separator, while allowing for a compact, inexpensive configuration of the bias applicator compared to that in which each of the transfer member and the media separator is provided with a dedicated high voltage power supply.

Several modifications and variations are possible to the image transfer device 30 according to the first embodiment described above.

For example, in a variation of the first embodiment, the direct current power from the DC power supply 304 may be a DC current, instead of a DC voltage. Also, the alternating current power from the AC power supply 305 may be an adjustable AC voltage, the amplitude of which is adjustable depending on whether the AC power supply is connected with the first electrode E1 or with the second electrode E2.

Specifically, the DC power supply 304 may be configured as a constant-current controlled circuit that outputs a current ranging from 0 to −400 μA to depending on size and thickness of recording medium S in use. For example, where the DC current from the DC power supply 304 has an amplitude of approximately −70 μA, the AC voltage from the AC power supply 305 is adjusted to a peak-to-peak amplitude of approximately 10 kV and a frequency of approximately 500 Hz for application to the first electrode E1 of the backup roller 33, and to a peak-to-peak amplitude of approximately 9 kV and a frequency of approximately 500 Hz for application to the second electrode E2 of the sheet separator 200.

Such arrangement not only enables protection against current leakage in a compact, inexpensive configuration of the bias applicator, but also allows for optimization of the bias voltage for each of the transfer member and the sheet separator owing to adjustability of the AC voltage output from the AC power supply.

Figure 5:
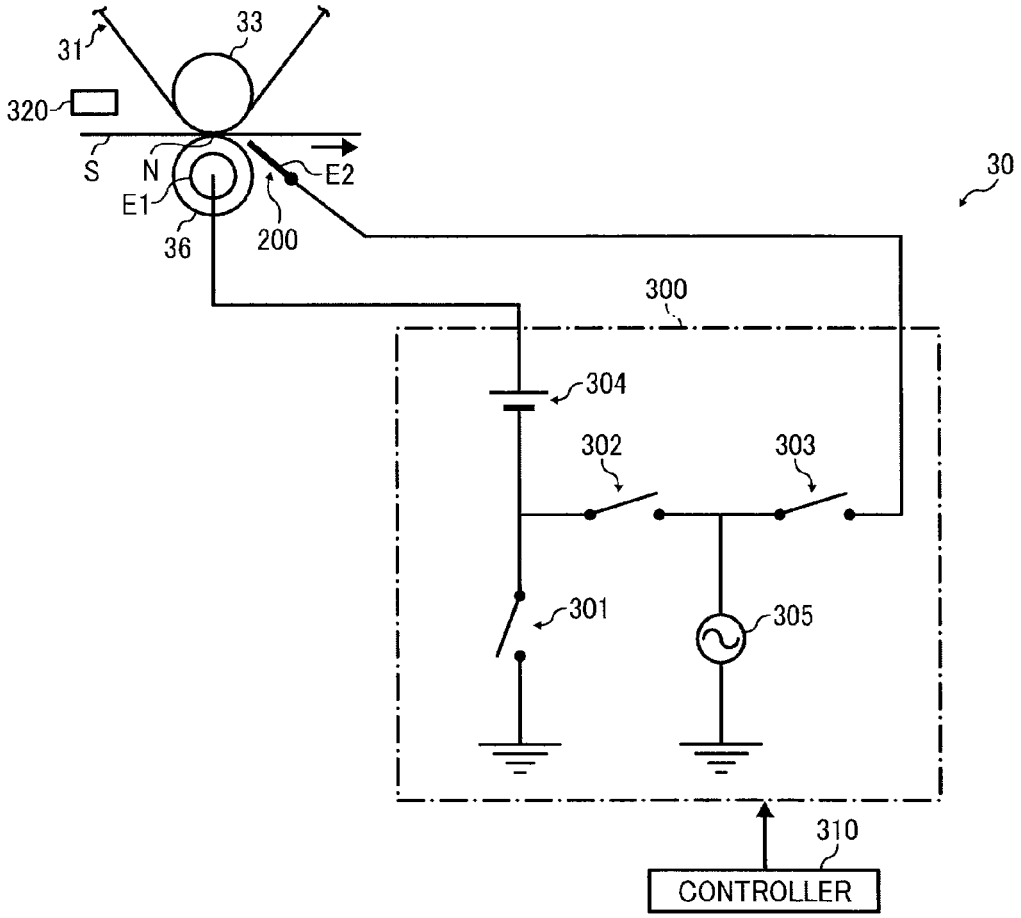
FIG. 5 is a partial view of the image transfer device according to a second embodiment of this patent specification.

FIG. 5 is a partial view of the image transfer device 30 according to a second embodiment of this patent specification.

As shown in FIG. 5, the overall configuration of the transfer device 30 is similar to that depicted primarily with reference to FIG. 3. Unlike the first embodiment, in the second embodiment, the metal core of the nip roller 36, instead of the backup roller 33, defines a first electrode E1 to which a first electrical bias is applied to electrostatically transfer the toner image from the image bearing surface to the recording sheet S across the transfer nip N.

Specifically, in the present embodiment, the power supply of the bias applicator 300 includes an AC power supply 305 connectable with each of the first and second electrodes E1 and E2 to generate an alternating current power for supply to the connected electrode, and a DC power supply 304 connectable in series with the first electrode E1 and the AC power supply 305 to generate a direct current power for supply to the first electrode E1. A switching circuit, consisting of first through third switches 301 through 303, is provided to selectively connect each of the DC power supply 304 and the AC power supply 305 to one of the first and second electrodes E1 and E2.

The DC power supply 304 has a positive terminal thereof connected to the electrode E1 of the nip roller 36 and a negative terminal thereof grounded via the first switch 301. The AC power supply 305 has one terminal thereof grounded, and another terminal thereof connected to the negative terminal of the DC power supply 304 via the second switch 302 and to the electrode E2 of the sheet separator 200 via the third switch 303.

The direct current power from the DC power supply 304 is a constant DC voltage and the alternating current power from the AC power supply 305 is an AC voltage. The AC voltage generated by the AC power supply 305 has a peak-to-peak amplitude ranging from 5 to 20 kV, preferably, from 8 to 15 kV, and a frequency ranging from 200 to 2,000 Hz, preferably, from 500 to 1,500 Hz. The DC voltage generated by the DC power supply 304 has an offset amplitude within a suitable range of, for example, from 0 to 5 kV, as dictated by Equation 1. For example, the AC power supply 305 may supply an AC voltage with a peak-to-peak amplitude of approximately 10 kV and a frequency of approximately 500 Hz, and the DC power supply 304 may supply a DC voltage with an offset amplitude of approximately 2 kV.

Figure 6A:
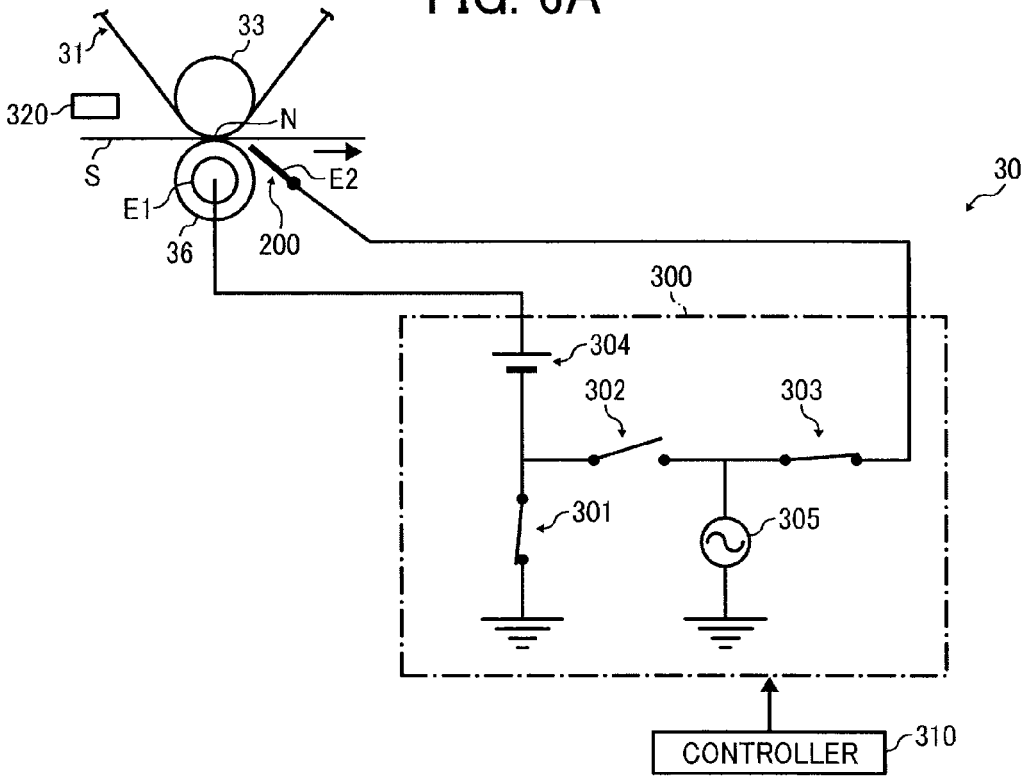
FIGS. 6A and 6B are further views of the image transfer device of FIG. 5.
Figure 6B:
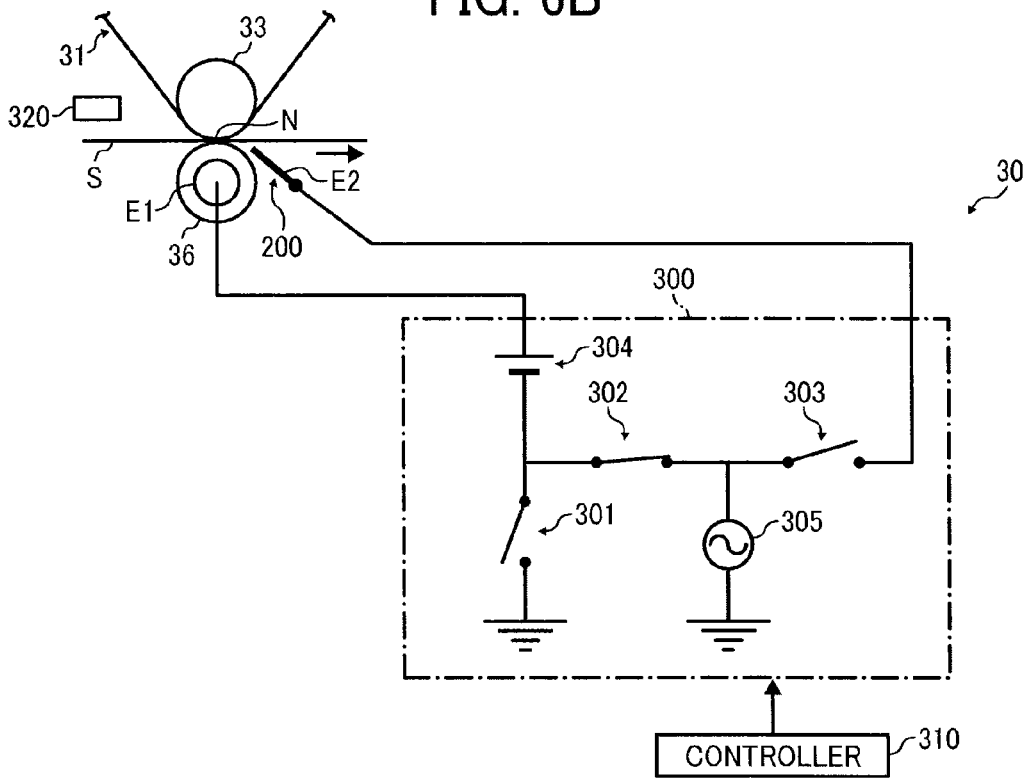

With additional reference to FIGS. 6A and 6B, the bias applicator 300 is shown including a controller 310 operatively connected to the switching circuit. As is the case with the foregoing embodiment, the controller 310 serves to control selective application of the electrical biases.

For example, as shown in FIG. 6A, to apply the direct current power to the first electrode E1, the controller 310 closes the first and third switches 301 and 303 while opening the second switch 302 to connect the DC power supply 304 with the first electrode E1 and the AC power supply 305 with the second electrode E2, resulting in a DC voltage supplied to the first electrode E1 and an AC voltage supplied to the second electrode E2. With the backup roller 33 at a ground potential, the first electrode E1 of the nip roller 36 thus energized by the DC power supply 304 creates a DC-only transfer bias across the transfer nip N between the opposed transfer members 33 and 36.

Conversely, as shown in FIG. 6B, to apply a combination of the direct current power and the alternating current power to the first electrode E1, the controller 310 opens the first and third switches 301 and 303 while closing the second switch 302 to connect the DC power supply 304 and the AC power supply 305 in series with the first electrode E1, resulting in AC and DC voltages supplied together to the first electrode E1 and no voltage supplied to the second electrode E2. With the backup roller 33 at a ground potential, the first electrode E1 of the nip roller 36 thus energized by the DC power supply 304 and the AC power supply 305 creates an AC-DC superimposed transfer bias across the transfer nip N between the opposed transfer members 33 and 36.

Further, as is the case with the foregoing embodiment, the controller 310 controls selective application of the electrical biases (that is, selection between a DC voltage or an AC-DC superimposed voltage to be applied across the transfer nip N) depending on the type (e.g., smoothness) of recording medium S in use as detected by the optical detector 320. Alternatively, instead, selective application of the electrical biases may be performed according to an input from a user, who selects a desired bias voltage to be used for a specific print job and submits it to the controller 310 through a suitable user interface.

Hence, the image transfer device 30 according to the second embodiment of this patent specification provides reliable electrostatic image transfer and media separation performance, wherein the bias applicator 300 with its power supply connectable with each of the first and second electrodes E1 and E2 prevents current leakage due to a phase difference between AC voltages simultaneously applied to the transfer member and the media separator, while allowing for a compact, inexpensive configuration of the bias applicator compared to that in which each of the transfer member and the media separator is provided with a dedicated high voltage power supply.

Several modifications and variations are possible to the image transfer device 30 according to the second embodiment described above.

For example, in a variation of the second embodiment, the direct current power from the DC power supply 304 may be a DC current, instead of a DC voltage. Also, the alternating current power from the AC power supply 305 may be an adjustable AC voltage, the amplitude of which is adjustable depending on whether the AC power supply is connected with the first electrode E1 or with the second electrode E2.

Specifically, the DC power supply 304 may be configured as a constant-current controlled circuit that outputs a current ranging from 0 to 400 μA to depending on size and thickness of recording medium S in use. For example, where the DC current from the DC power supply 304 has an amplitude of approximately 70 μA, the AC voltage from the AC power supply 305 is adjusted to a peak-to-peak amplitude of approximately 10 kV and a frequency of approximately 500 Hz for application to the first electrode E1 of the nip roller 36, and to a peak-to-peak amplitude of approximately 9 kV and a frequency of approximately 500 Hz for application to the second electrode E2 of the sheet separator 200.

Such arrangement not only enables protection against current leakage in a compact, inexpensive configuration of the bias applicator, but also allows for optimization of the bias voltage for each of the transfer member and the sheet separator owing to adjustability of the AC voltage output from the AC power supply.

Figure 7:
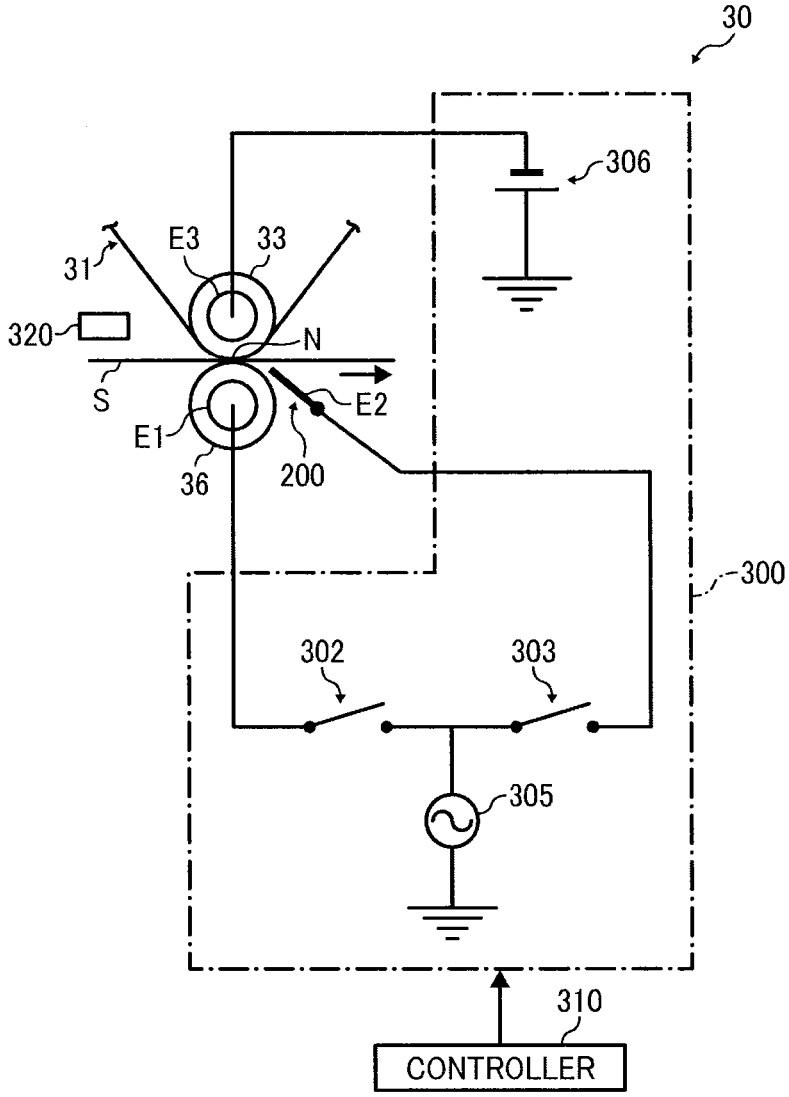
FIG. 7 is a partial view of the image transfer device according to a third embodiment of this patent specification.

FIG. 7 is a partial view of the image transfer device 30 according to a third embodiment of this patent specification.

As shown in FIG. 7, the overall configuration of the transfer device 30 is similar to that depicted primarily with reference to FIG. 5. Unlike the second embodiment, in the third embodiment, the metal core of the backup roller 33 defines a third electrode E3 to which a third bias voltage is applied to facilitate electrostatic transfer of the toner image from the image bearing surface to the recording medium S across the transfer nip N.

Specifically, in the present embodiment, the power supply of the bias applicator 300 includes an AC power supply 305 connectable with each of the first and second electrodes E1 and E2 to generate an alternating current power for supply to the connected electrode, and a DC power supply 306 connected with the third electrode E3 to generate a direct current power for supply to the third electrode E3. A switching circuit, consisting of second and third switches 302 through 303, is provided to selectively connect the AC power supply 305 to one of the first and second electrodes E1 and E2.

The DC power supply 306 has a negative terminal thereof connected to the electrode E3 of the backup roller 33 and a positive terminal thereof grounded. The AC power supply 305 has one terminal thereof grounded, and another terminal thereof connected to the electrode E1 of the nip roller 36 via the second switch 302 and to the electrode E2 of the sheet separator 200 via the third switch 303.

The direct current power from the DC power supply 306 is a constant DC voltage and the alternating current power from the AC power supply 305 is an AC voltage. The AC voltage generated by the AC power supply 305 has a peak-to-peak amplitude ranging from 5 to 20 kV, preferably, from 8 to 15 kV, and a frequency ranging from 200 to 2,000 Hz, preferably, from 500 to 1,500 Hz. The DC voltage generated by the DC power supply 306 has an offset amplitude within a suitable range of, for example, from 0 to −5 kV, as dictated by Equation 1. For example, the AC power supply 305 may supply an AC voltage with a peak-to-peak amplitude of approximately 10 kV and a frequency of approximately 500 Hz, and the DC power supply 306 may supply a DC voltage with an offset amplitude of approximately −2 kV.

Figure 8A:
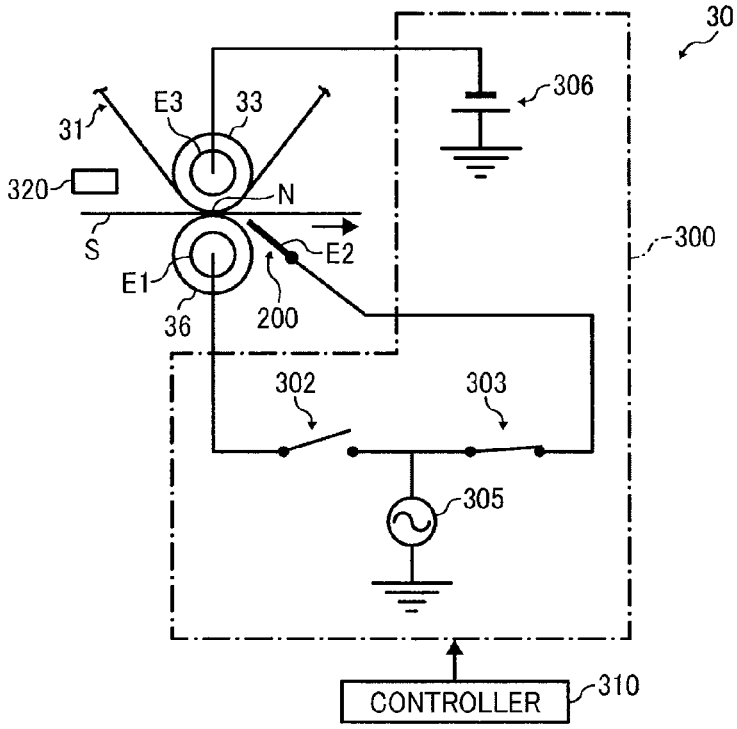
FIGS. 8A and 8B are further views of the image transfer device of FIG. 7.
Figure 8B:
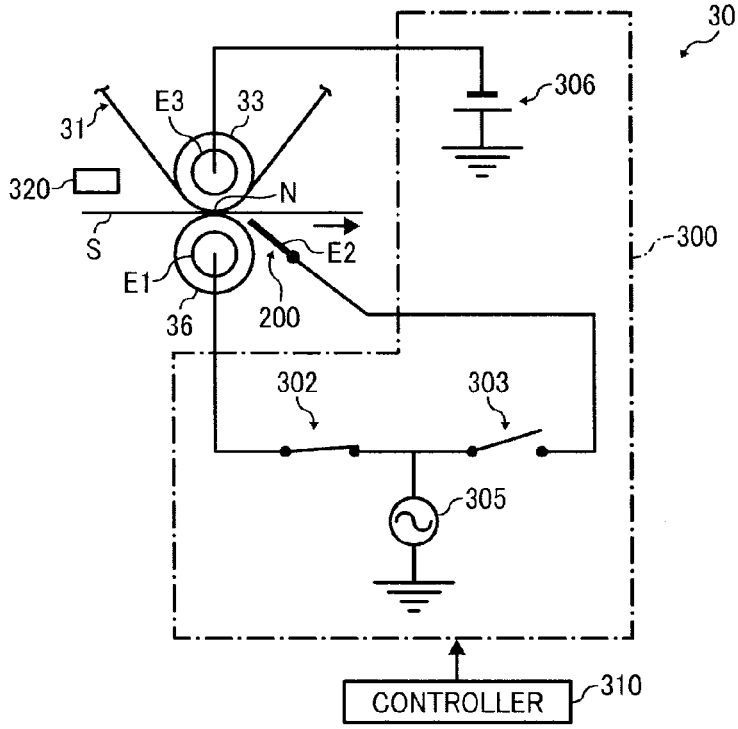

With additional reference to FIGS. 8A and 8B, the bias applicator 300 is shown including a controller 310 operatively connected to the switching circuit. As is the case with the foregoing embodiment, the controller 310 serves to control selective application of the electrical biases.

For example, as shown in FIG. 8A, to apply the alternating current power to the second electrode E2, the controller 310 closes the third switch 303 while opening the second switch 302 to connect the AC power supply 305 to the second electrode E2, resulting in an AC voltage supplied to the second electrode E2 and no voltage supplied to the first electrode E1. With the nip roller 36 thus at a ground potential, the backup roller 33 energized by the DC power supply 306 creates a DC-only transfer bias across the transfer nip N between the opposed transfer members 33 and 36.

Conversely, as shown in FIG. 8B, to apply the alternating current power to the first electrode E1, the controller 310 opens the third switch 303 while closing the second switch 302 to connect the AC power supply 305 to the first electrode E1, resulting in an AC voltage supplied to the first electrode E1 and no voltage supplied to the second electrode E2. The nip roller 36 thus energized by the AC power supply 305, together with the backup roller 33 energized by the DC power supply 306, create an AC-DC superimposed transfer bias across the transfer nip N between the opposed transfer members 33 and 36.

Further, as is the case with the foregoing embodiment, the controller 310 controls selective application of the electrical biases (that is, selection between a DC voltage or an AC-DC superimposed voltage to be applied across the transfer nip N) depending on the type (e.g., smoothness) of recording medium S in use, as detected by the optical detector 320. Alternatively, instead, selective application of the electrical biases may be performed according to an input from a user, who selects a desired bias voltage to be used for a specific print job and submits it to the controller 310 through a suitable user interface.

Hence, the image transfer device 30 according to the third embodiment of this patent specification provides reliable electrostatic image transfer and media separation performance, wherein the bias applicator 300 with its power supply connectable with each of the first and second electrodes E1 and E2 prevents current leakage due to a phase difference between AC voltages simultaneously applied to the transfer member and the media separator, while allowing for a compact, inexpensive configuration of the bias applicator compared to that in which each of the transfer member and the media separator is provided with a dedicated high voltage power supply.

Several modifications and variations are possible to the image transfer device 30 according to the third embodiment described above.

For example, in a variation of the third embodiment, the direct current power from the DC power supply 306 may be a DC current, instead of a DC voltage. Also, the alternating current power from the AC power supply 305 may be an adjustable AC voltage, the amplitude of which is adjustable depending on whether the AC power supply is connected with the first electrode E1 or with the second electrode E2.

Specifically, the DC power supply 306 may be configured as a constant-current controlled circuit that outputs a current ranging from 0 to −400 μA depending on size and thickness of recording medium S in use. For example, where the DC current from the DC power supply 306 has an amplitude of approximately −70 μA, the AC voltage from the AC power supply 305 is adjusted to a peak-to-peak amplitude of approximately 10 kV and a frequency of approximately 500 Hz for application to the first electrode E1 of the nip roller 36, and to a peak-to-peak amplitude of approximately 9 kV and a frequency of approximately 500 Hz for application to the second electrode E2 of the sheet separator 200.

Such arrangement not only enables protection against current leakage in a compact, inexpensive configuration of the bias applicator, but also allows for optimization of the bias voltage for each of the transfer member and the sheet separator owing to adjustability of the AC voltage output from the AC power supply.

Figure 9:
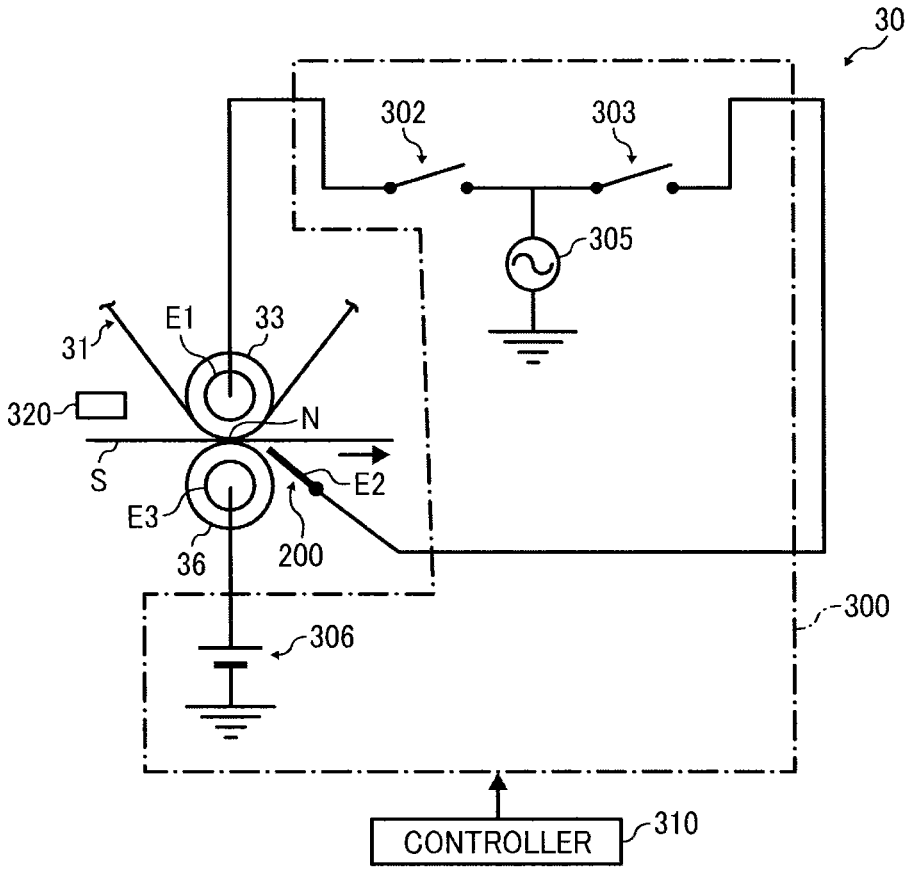
FIG. 9 is a partial view of the transfer device according to a fourth embodiment of this patent specification.

FIG. 9 is a partial view of the transfer device 30 according to a fourth embodiment of this patent specification.

As shown in FIG. 9, the overall configuration of the transfer device 30 is similar to that depicted primarily with reference to FIG. 3. Unlike the first embodiment, in the fourth embodiment, the metal core of the nip roller 36 defines a third electrode E3 to which a third bias voltage is applied to facilitate electrostatic transfer of the toner image from the image bearing surface to the recording medium S across the transfer nip N.

Specifically, in the present embodiment, the power supply of the bias applicator 300 includes an AC power supply 305 connectable with each of the first and second electrodes E1 and E2 to generate an alternating current power for supply to the connected electrode, and a DC power supply 306 connected with the third electrode E3 to generate a direct current power for supply to the third electrode E3. A switching circuit, consisting of second and third switches 302 and 303, is provided to selectively connect the AC power supply 305 to one of the first and second electrodes E1 and E2.

The DC power supply 306 has a positive terminal thereof connected to the electrode E3 of the nip roller 36 and a negative terminal thereof grounded. The AC power supply 305 has one terminal thereof grounded, and another terminal thereof connected to the electrode E1 of the backup roller 33 via the second switch 302 and to the electrode E2 of the sheet separator 200 via the third switch 303.

The direct current power from the DC power supply 306 is a constant DC voltage and the alternating current power from the AC power supply 305 is an AC voltage. The AC voltage generated by the AC power supply 305 has a peak-to-peak amplitude ranging from 5 to 20 kV, preferably, from 8 to 15 kV, and a frequency ranging from 200 to 2,000 Hz, preferably, from 500 to 1,500 Hz. The DC voltage generated by the DC power supply 304 has an offset amplitude within a suitable range of, for example, from 0 to 5 kV, as dictated by Equation 1. For example, the AC power supply 305 may supply an AC voltage with a peak-to-peak amplitude of approximately 10 kV and a frequency of approximately 500 Hz, and the DC power supply 306 may supply a DC voltage with an offset amplitude of approximately 2 kV.

Figure 10A:
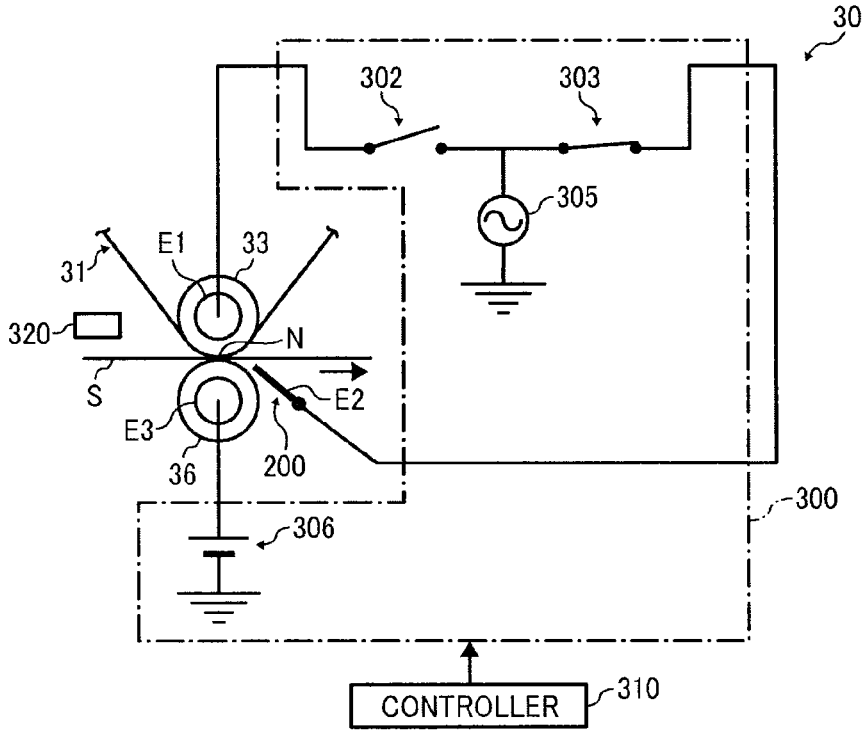
FIGS. 10A and 10B are further views of the image transfer device of FIG. 9.
Figure 10B:
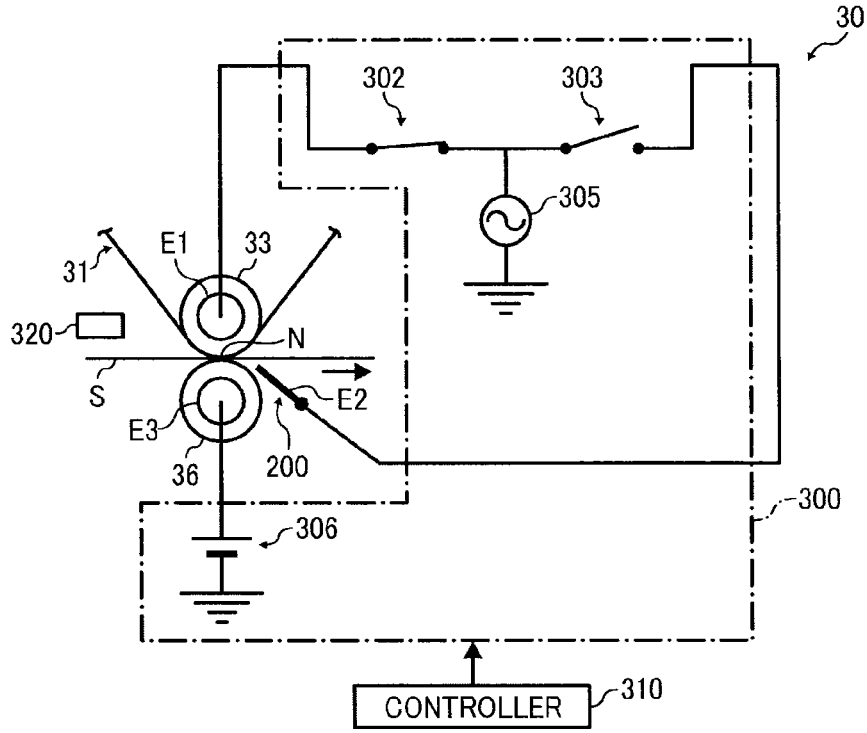

With additional reference to FIGS. 10A and 10B, the bias applicator 300 is shown including a controller 310 operatively connected to the switching circuit. As is the case with the foregoing embodiment, the controller 310 serves to control selective application of the electrical biases.

For example, as shown in FIG. 10A, to apply the alternating current power from the AC power supply 305 to the second electrode E2, the controller 310 closes the third switch 303 while opening the second switch 302 to connect the AC power supply 305 to the second electrode E2, resulting in an AC voltage supplied to the second electrode E2 and no voltage supplied to the first electrode E1. With the backup roller 33 thus at a ground potential, the nip roller 36 energized by the DC power supply 306 creates a DC-only transfer bias across the transfer nip N between the opposed transfer members 33 and 36.

Conversely, as shown in FIG. 10B, to apply the alternating current power from the AC power supply 305 to the first electrode E1, the controller 310 opens the third switch 303 while closing the second switch 302 to connect the AC power supply 305 to the first electrode E1, resulting in an AC voltage supplied to the first electrode E1 and no voltage supplied to the second electrode E2. The backup roller 33 thus energized by the AC power supply 305, together with the nip roller 36 energized by the DC power supply 306, create an AC-DC superimposed transfer bias across the transfer nip N between the opposed transfer members 33 and 36.

Further, as is the case with the foregoing embodiment, the controller 310 controls selective application of the electrical biases (that is, selection between a DC voltage or an AC-DC superimposed voltage to be applied across the transfer nip N) depending on the type (e.g., smoothness) of recording medium S in use, as detected by the optical detector 320. Alternatively, instead, selective application of the electrical biases may be performed according to an input from a user, who selects a desired bias voltage to be used for a specific print job and submits it to the controller 310 through a suitable user interface.

Hence, the image transfer device 30 according to the fourth embodiment of this patent specification provides reliable electrostatic image transfer and media separation performance, wherein the bias applicator 300 with its power supply connectable with each of the first and second electrodes E1 and E2 prevents current leakage due to a phase difference between AC voltages simultaneously applied to the transfer member and the media separator, while allowing for a compact, inexpensive configuration of the bias applicator compared to that in which each of the transfer member and the media separator is provided with a dedicated high voltage power supply.

Several modifications and variations are possible to the image transfer device 30 according to the fourth embodiment described above.

For example, in a variation of the fourth embodiment, the direct current power from the DC power supply 306 may be a DC current, instead of a DC voltage. Also, the alternating current power from the AC power supply 305 may be an adjustable AC voltage, the amplitude of which is adjustable depending on whether the AC power supply is connected with the first electrode E1 or with the second electrode E2.

Specifically, the DC power supply 306 may be configured as a constant-current controlled circuit that outputs a current ranging from 0 to 400 μA to depending on size and thickness of recording medium S in use. For example, where the DC current from the DC power supply 306 has an amplitude of approximately 70 μA, the AC voltage from the AC power supply 305 is adjusted to a peak-to-peak amplitude of approximately 10 kV and a frequency of approximately 500 Hz for application to the first electrode E1 of the backup roller 33, and to a peak-to-peak amplitude of approximately 9 kV and a frequency of approximately 500 Hz for application to the second electrode E2 of the sheet separator 200.

Such arrangement not only enables protection against current leakage in a compact, inexpensive configuration of the bias applicator, but also allows for optimization of the bias voltage for each of the transfer member and the sheet separator owing to adjustability of the AC voltage output from the AC power supply.

Figure 11:
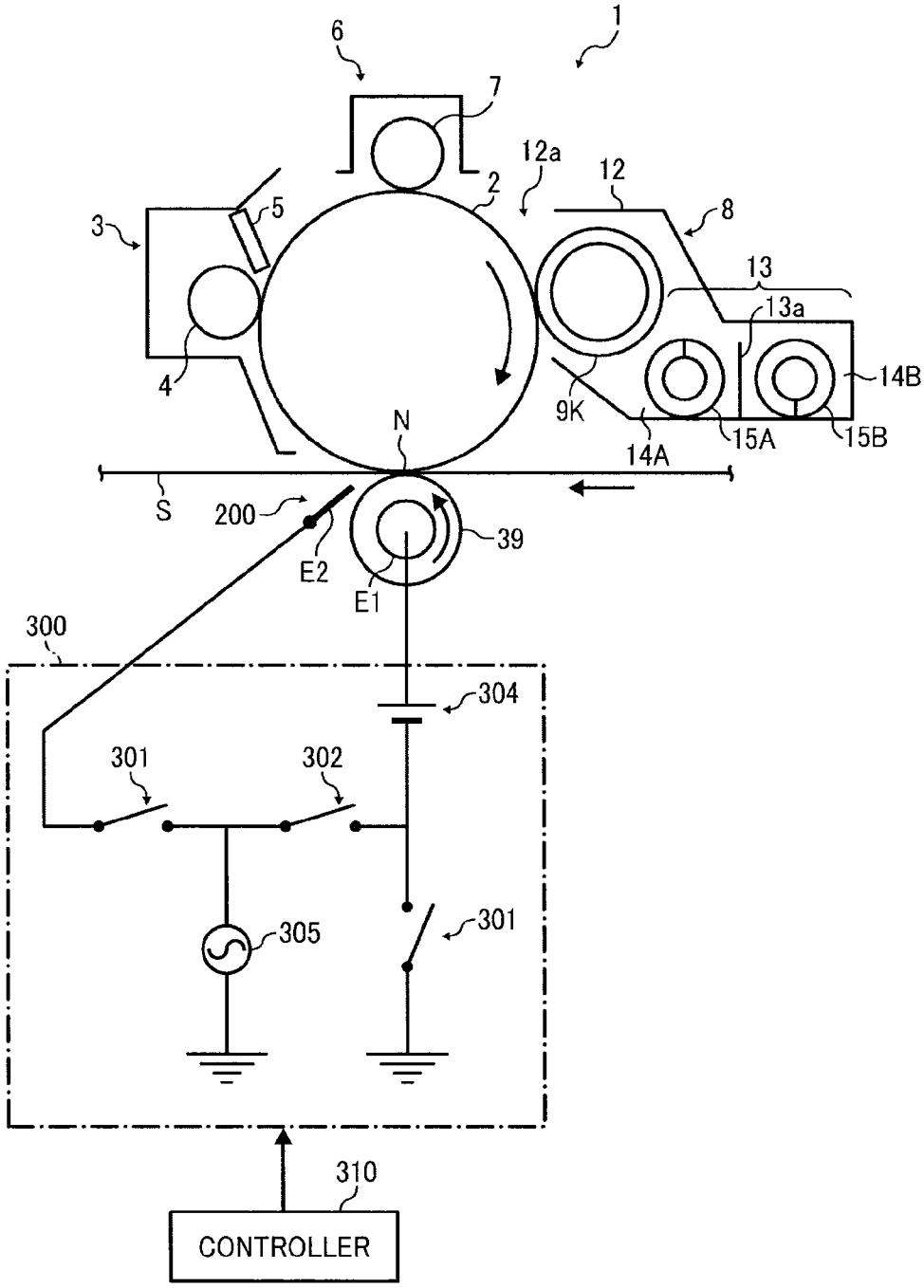
FIG. 11 is a partial view of the image transfer device according to a fifth embodiment of this patent specification.

FIG. 11 is a partial view of the image transfer device 30 according to a fifth embodiment of this patent specification.

As shown in FIG. 11, the image transfer device 30 comprises a direct transfer mechanism for transferring a toner image from a photoconductor drum 2 defining an image bearing surface on which the toner image is created, including a transfer member, being a direct transfer roller 39, disposed opposite the photoconductor 2 to form a transfer nip N therebetween through which a recording medium S is passed. The metal core of the transfer roller 39 defines a first electrode E1 to which a first electrical bias is applied to electrostatically transfer the toner image from the image bearing surface to the recording medium S across the transfer nip N.

The image transfer device 30 also includes a sheet separator 200 and an electrical bias applicator 300. The sheet separator 200, being a discharge needle with a sawtoothed edge, defines a second electrode E2 downstream from the transfer nip N to which a second electrical bias is applied to separate or assist in separating the recording medium S from the image bearing surface after exiting the transfer nip N. The electrical bias applicator 300 includes a power supply connectable with each of the first and second electrodes E1 and E2 to supply the first electrical bias to the first electrode E1 and the second electrical bias to the second electrode E2.

Specifically, in the present embodiment, the power supply of the bias applicator 300 includes an AC power supply 305 connectable with each of the first and second electrodes E1 and E2 to generate an alternating current power for supply to the connected electrode, and a DC power supply 304 connectable in series with the first electrode E1 and the AC power supply 305 to generate a direct current power for supply to the first electrode E1. A switching circuit, consisting of first through third switches 301 through 303, is provided to selectively connect each of the DC power supply 304 and the AC power supply 305 to one of the first and second electrodes E1 and E2.

The DC power supply 304 has a positive terminal thereof connected to the electrode E1 of the transfer roller 39 and a negative terminal thereof grounded via the first switch 301. The AC power supply 305 has one terminal thereof grounded, and another terminal thereof connected to the negative terminal of the DC power supply 304 via the second switch 302 and to the electrode E2 of the sheet separator 200 via the third switch 303.

The direct current power from the DC power supply 304 is a constant DC voltage and the alternating current power from the AC power supply 305 is an AC voltage. The AC voltage generated by the AC power supply 305 and the DC voltage generated by the DC power supply 304 are dimensioned to suitable amplitudes. For example, the AC power supply 305 may supply an AC voltage with a peak-to-peak amplitude of approximately 10 kV and a frequency of approximately 500 Hz, and the DC power supply 304 may supply a DC voltage with an offset amplitude of approximately 2 kV.

Figure 12A:
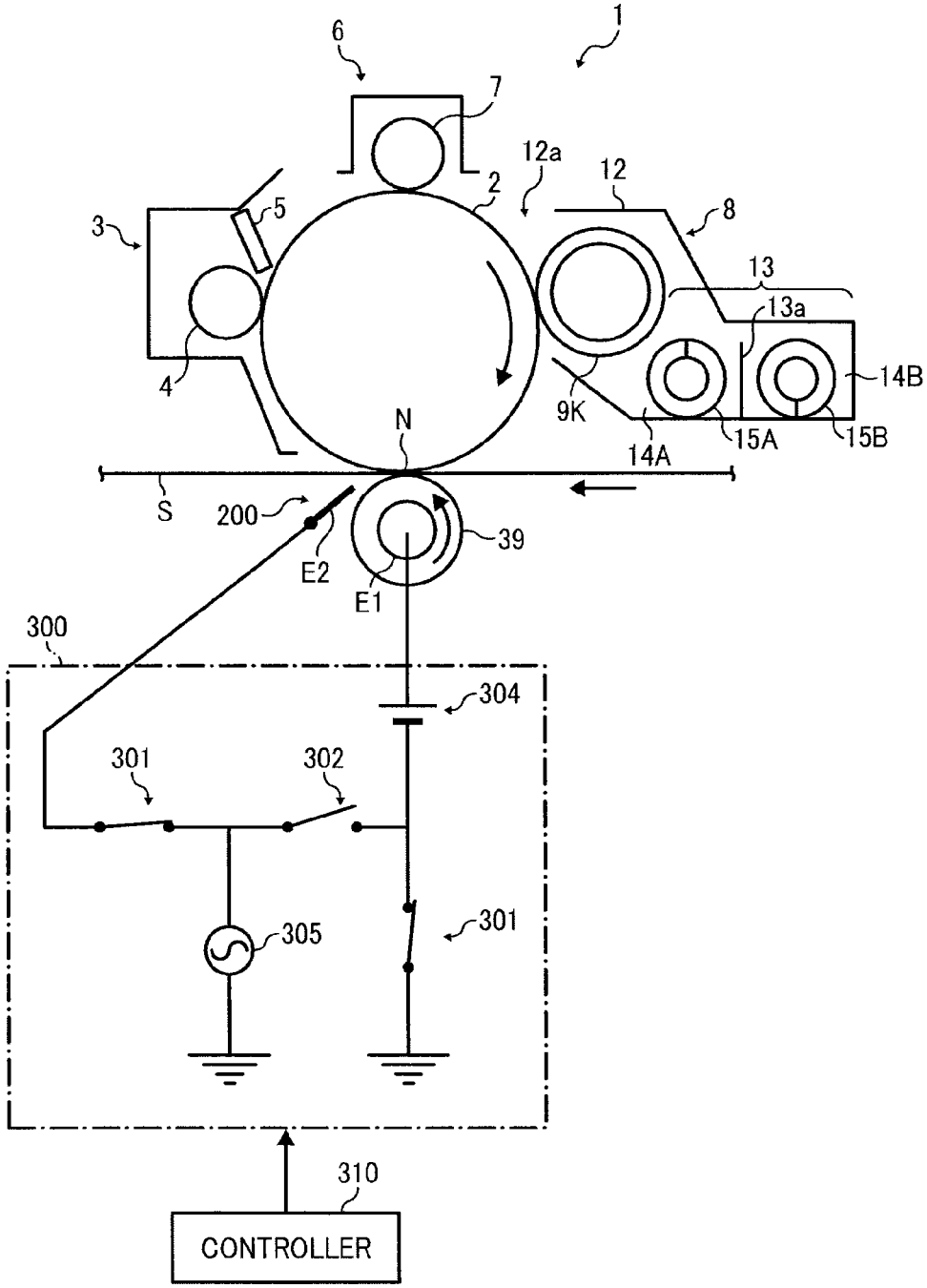
FIGS. 12A and 12B are further views of the image transfer device of FIG. 11.
Figure 12B:
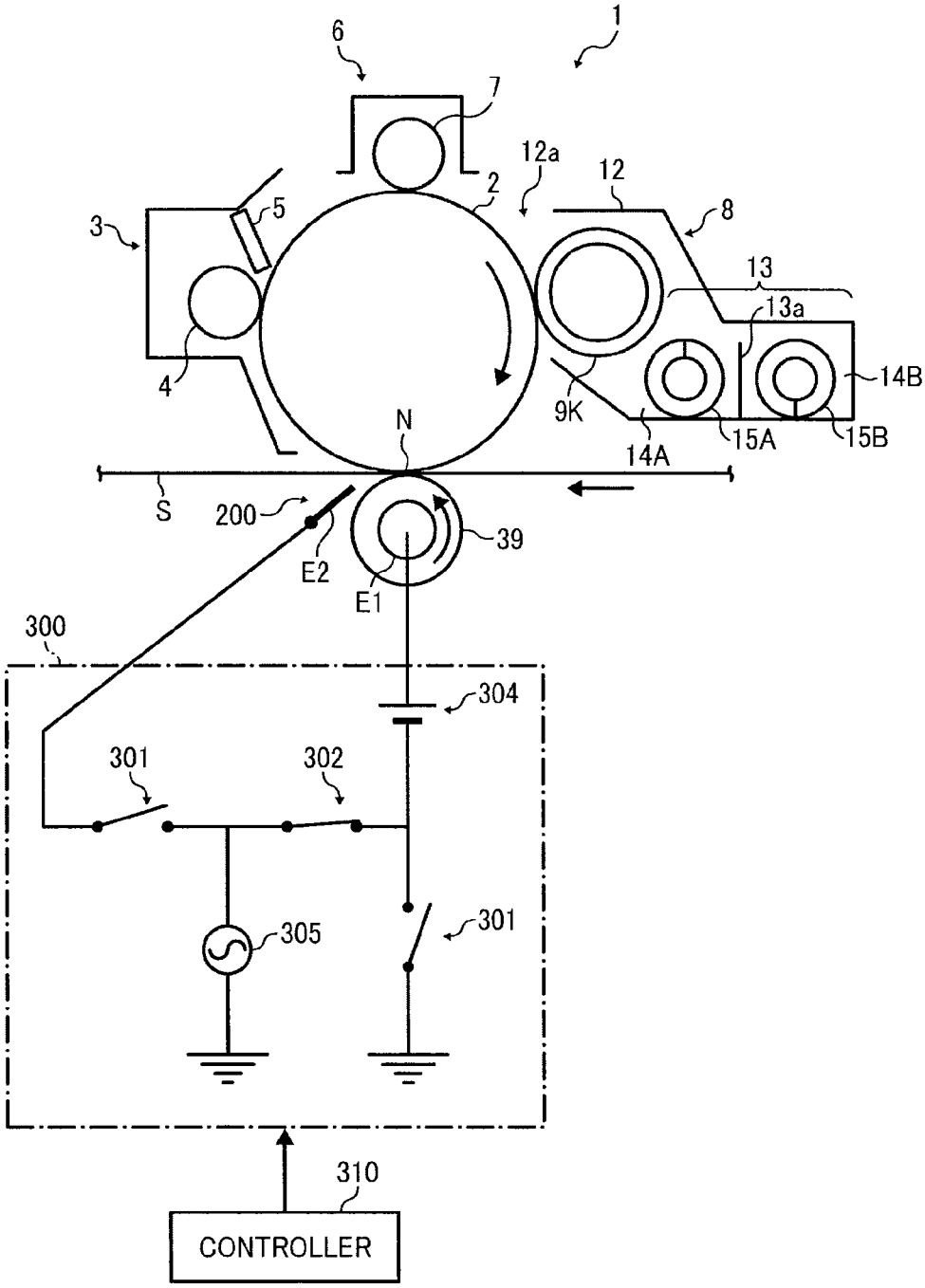

With additional reference to FIGS. 12A and 12B, the bias applicator 300 is shown including a controller 310 operatively connected to the switching circuit. As is the case with the foregoing embodiment, the controller 310 serves to control selective application of the electrical biases.

For example, as shown in FIG. 12A, to apply the direct current power to the first electrode E1, the controller 310 closes the first and third switches 301 and 303 while opening the second switch 302 to connect the DC power supply 304 with the first electrode E1 and the AC power supply 305 with the second electrode E2, resulting in a DC voltage supplied to the first electrode E1 and an AC voltage supplied to the second electrode E2. The first electrode E1 of the transfer roller 39 thus energized by the DC power supply 304 creates a DC-only transfer bias across the transfer nip N between the photoconductor drum 2 and the transfer member 39.

Conversely, as shown in FIG. 12B, to apply a combination of the direct current power and the alternating current power to the first electrode E1, the controller 310 opens the first and third switches 301 and 303 while closing the second switch 302 to connect the DC power supply 304 and the AC power supply 305 in series with the first electrode E1, resulting in AC and DC voltages supplied together to the first electrode E1 and no voltage supplied to the second electrode E2. The first electrode E1 of the transfer roller 39 thus energized by the DC power supply 304 and the AC power supply 305 creates an AC-DC superimposed transfer bias across the transfer nip N between the photoconductor drum 2 and the transfer member 39.

Further, as is the case with the foregoing embodiment, the controller 310 controls selective application of the electrical biases (that is, selection between a DC voltage or an AC-DC superimposed voltage to be applied across the transfer nip N) depending on the type (e.g., smoothness) of recording medium S in use. Alternatively, instead, selective application of the electrical biases may be performed according to an input from a user, who selects a desired bias voltage to be used for a specific print job and submits it to the controller 310 through a suitable user interface.

Hence, the image transfer device 30 according to the second embodiment of this patent specification provides reliable electrostatic image transfer and media separation performance, wherein the bias applicator 300 with its power supply connectable with each of the first and second electrodes E1 and E2 prevents current leakage due to a phase difference between AC voltages simultaneously applied to the transfer member and the media separator, while allowing for a compact, inexpensive configuration of the bias applicator compared to that in which each of the transfer member and the media separator is provided with a dedicated high voltage power supply.

To recapitulate, the image transfer device 30 according to several embodiments of this patent specification includes an image bearing member 31 defining an image bearing surface on which a toner image is created; a pair of opposed transfer members 33 and 36 disposed opposite each other via the image bearing member 31 to form a transfer nip N therebetween through which a recording medium S is passed, one of the transfer members 33 and 36 defining a first electrode E1 to which a first electrical bias is applied to electrostatically transfer the toner image from the image bearing surface to the recording medium S across the transfer nip N; a media separator 200 defining a second electrode E2 downstream from the transfer nip N to which a second electrical bias is applied to separate the recording medium S from the image bearing surface after exiting the transfer nip; and an electrical bias applicator 300 including a power supply connectable with each of the first and second electrodes E1 and E2 to supply the first electrical bias to the first electrode E1 and the second electrical bias to the second electrode E2.

The one of the transfer members defining the first electrode E1 may be a backup roller 33 contacting a surface opposite the image bearing surface of the image bearing member 31. Alternatively, instead, the one of the transfer members defining the first electrode E1 may be a nip roller 36 contacting the image bearing surface of the image bearing member 31.

The power supply of the bias applicator 200 may be an AC power supply 305 connectable with each of the first and second electrodes E1 and E2 to generate an alternating current power for supply to the connected electrode. In such cases, the bias applicator 200 includes a switching circuit or switch 303 to selectively connect the AC power supply to one of the first and second electrodes E1 and E2, and a controller 310 operatively connected to the switching circuit 303 to selectively apply the alternating current power to either one of the first and second electrodes E1 and E2.

The power supply of the bias applicator 200 may be a combination of an AC power supply 305 connectable with each of the first and second electrodes E1 and E2 to generate an alternating current power for supply to the connected electrode, and a DC power supply 304 connectable in series with the first electrode E1 and the AC power supply 305 to generate a direct current power for supply to the first electrode E1. In such cases, the bias applicator 200 includes a switching circuit or switches 301 and 302 to selectively connect each of the AC and DC power supplies 305 and 304 to one of the first and second electrodes E1 and E2, and a controller 310 operatively connected to the switching circuit to selectively apply either the direct current power, or a combination of the direct current power and the alternating current power to the first electrode E1.

The image transfer device 30 may be provided with a recording medium detector 320 to detect the type of recording medium in use, whereby the controller 310 may control selective application of the electrical biases depending on the detected type of recording medium S in use.

The direct current power from the DC power supply 304 may be a DC voltage or a DC current. The alternating current power from the AC power supply 305 may be an AC voltage, in particular, an adjustable AC voltage the amplitude of which is adjustable depending on whether the AC power supply is connected with the first electrode E1 or with the second electrode E2.

Further, one of the transfer members, different from the one defining the first electrode E1, may define a third electrode E3 to which a third electrical bias is applied to facilitate electrostatic transfer of the toner image from the image bearing surface to the recording medium S across the transfer nip N.

The one of the transfer members defining the first electrode E1 may be a backup roller 33 contacting a surface opposite the image bearing surface of the image bearing member 31, and the other one of the transfer members defining the third electrode E3 may be a nip roller 36 contacting the image bearing surface of the image bearing member 31.

Alternatively, instead, the one of the transfer members defining the first electrode E1 may be a nip roller 36 contacting the image bearing surface of the image bearing member 31, and the other one of the transfer members 33 and 36 defining the third electrode E3 may be a backup roller 33 contacting a surface opposite the image bearing surface of the image bearing member 31.

The power supply of the bias applicator 200 may be a combination of an AC power supply 305 connectable with each of the first and second electrodes E1 and E2 to generate an alternating current power for supply to the connected electrode, and a DC power supply 306 connected with the third electrode E3 to generate a direct current power for supply to the third electrode E3. In such cases, the bias applicator 200 includes a switching circuit or switches 302 and 303 to selectively connect the AC power supply 305 to one of the first and second electrodes E1 and E2, and a controller 310 operatively connected to the switching circuit to control the switching circuit to selectively apply the alternating current power to either one of the first and second electrodes E1 and E2.

The image transfer device 30 may be provided with a recording medium detector 320 to detect the type of recording medium in use, whereby the controller 310 may control selective application of the electrical biases depending on the detected type of recording medium S in use. The direct current power from the DC power supply 306 may be a DC voltage or a DC current. The alternating current power from the AC power supply 305 may be an AC voltage, in particular, an adjustable AC voltage the amplitude of which is adjustable depending on whether the AC power supply is connected with the first electrode E1 or with the second electrode E2.

The image transfer device 30 according to further embodiment of this patent specification transfers a toner image from an image bearing member 2 defining an image bearing surface on which the toner image is created, including a transfer member 39 disposed opposite the image bearing member 2 to form a transfer nip N therebetween through which a recording medium S is passed, the transfer member 39 defining a first electrode E1 to which a first electrical bias is applied to electrostatically transfer the toner image from the image bearing surface to the recording medium S across the transfer nip N; a media separator 200 defining a second electrode E2 downstream from the transfer nip N to which a second electrical bias is applied to separate the recording medium S from the image bearing surface after exiting the transfer nip N; and an electrical bias applicator 300 including a power supply connectable with each of the first and second electrodes E1 and E2 to supply the first electrical bias to the first electrode E1 and the second electrical bias to the second electrode E2.

The image forming apparatus 100 according to still further embodiment of this patent specification includes means for defining an image bearing surface on which a toner image is created; means for forming a transfer nip N through which a recording medium is passed while pressed against the image bearing surface; a first electrode E1, disposed facing the transfer nip, to which a first electrical bias is applied to electrostatically transfer the toner image from the image bearing surface to the recording medium S; a second electrode E2, disposed downstream from the transfer nip, to which a second electrical bias is applied to separate the recording medium S from the image bearing surface after exiting the transfer nip N; and an electrical bias applicator 300 including a power supply connectable with each of the first and second electrodes E1 and E2 to supply the first electrical bias to the first electrode E1 and the second electrical bias to the second electrode E2.

Hence, the image transfer device according to these and other embodiments of this patent specification provides reliable electrostatic image transfer and media separation performance. Since the bias applicator derives electrical power for application to each of the transfer member and the media separator from the single power supply, there is no risk of simultaneously applying different AC voltages to the transfer member and the media separator, which would otherwise result in a potential difference and concomitant leakage current between the transfer member and the media separator.

Such bias application enables reliable protection against current leakage which does not necessitate complicated control circuitry for adjusting a transfer bias voltage relative to a media separator bias voltage. Also, using the single power supply connectable with both of the transfer member and the media separator, as opposed to providing a dedicated power supply for each of the transfer member and the media separator, allows for a compact, inexpensive configuration of the voltage applicator.

In addition, provision of the switching circuit and the controller, which allows for selective, non-simultaneous application of the alternating current power to the first and second electrodes, prevents interference between the first and second electrical biases applied to the transfer member and the media separator.

The image forming apparatus is not limited to a tandem color printer with an intermediate transfer capability, but includes any type of image forming apparatus, such as a photocopier, facsimile machine, printer, plotter, or multifunctional machine incorporating several of those imaging functions, which may be designed with either a direct transfer unit or an intermediate transfer unit, and which may be configured to perform either monochrome printing or multicolor printing.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image transfer device, comprising:

an image bearing member defining an image bearing surface on which a toner image is created;

a pair of opposed transfer members disposed opposite each other via the image bearing member to form a transfer nip therebetween through which a recording medium is passed, one of the transfer members defining a first electrode to which a first electrical bias is applied to electrostatically transfer the toner image from the image bearing surface to the recording medium across the transfer nip;

a media separator defining a second electrode downstream from the transfer nip to which a second electrical bias is applied to separate the recording medium from the image bearing surface after exiting the transfer nip; and an electrical bias applicator including a single power supply that connects to the first electrode to supply at least one component of the first electrical bias to the first electrode and connects to the second electrode to supply the second electrical bias to the second electrode.

2. The image transfer device according to claim 1, wherein the single power supply comprises an AC power supply that connects with each of the first electrode and the second electrode to generate an alternating current power for supply to a connected electrode.

3. The image transfer device according to claim 2, wherein the bias applicator further includes:

a switching circuit to selectively connect the AC power supply to one of the first electrode and the second electrode; and a controller operatively connected to the switching circuit to selectively apply the alternating current power to either one of the first electrode and the second electrode.

4. The image transfer device according to claim 1, wherein the electrical bias applicator further comprises a second power supply, wherein the single power supply comprises an AC power supply that connects with each of the first electrode and the second electrode to generate an alternating current power for supply to a connected electrode, and wherein the second power supply comprises a DC power supply that connects in series with the first electrode and the AC power supply to generate a direct current power for supply to the first electrode.

5. The image transfer device according to claim 4, wherein the bias applicator further includes:

a switching circuit to selectively connect each of the AC power supply and DC power supply to one of the first electrode and the second electrode; and a controller operatively connected to the switching circuit to selectively apply either the direct current power or a combination of the direct current power and the alternating current power to the first electrode.

6. The image transfer device according to claim 5, further comprising a recording medium detector to detect the type of recording medium in use, wherein the controller controls selective application of the first electrical bias and the second electrical bias depending on the detected type of recording medium in use.

7. The image transfer device according to claim 4, wherein the direct current power from the DC power supply is a DC voltage, and the alternating current power from the AC power supply is an AC voltage.

8. The image transfer device according to claim 4, wherein the direct current power from the DC power supply is a DC current, and the alternating current power from the AC power supply is an AC voltage.

9. The image transfer device according to claim 4, wherein the alternating current power from the AC power supply is an adjustable AC voltage, the amplitude of the AC voltage being adjustable depending on whether the AC power supply is connected with the first electrode or with the second electrode.

10. The image transfer device according to claim 1, wherein the one of the transfer members defining the first electrode comprises a backup roller contacting a surface opposite the image bearing surface of the image bearing member.

11. The image transfer device according to claim 1, wherein the one of the transfer members defining the first electrode comprises a nip roller contacting the image bearing surface of the image bearing member.

12. The image transfer device according to claim 1, wherein one of the transfer members, different from the one defining the first electrode, defines a third electrode to which a third electrical bias is applied to facilitate electrostatic transfer of the toner image from the image bearing surface to the recording medium across the transfer nip.

13. The image transfer device according to claim 12, wherein the electrical bias applicator further comprises a second power supply, wherein the single power supply comprises an AC power supply that connects with each of the first electrode and the second electrode to generate an alternating current power for supply to a connected electrode, and wherein the second power supply comprises a DC power supply that connects with the third electrode to generate a direct current power for supply to the third electrode.

14. The image transfer device according to claim 13, wherein the bias applicator further includes:

a switching circuit to selectively connect the AC power supply to one of the first electrode and the second electrode; and a controller operatively connected to the switching circuit to selectively apply the alternating current power to either one of the first electrode and the second electrode.

15. The image transfer device according to claim 13, wherein the direct current power from the DC power supply is a DC voltage and the alternating current power from the AC power supply is an AC voltage.

16. The image transfer device according to claim 13, wherein the direct current power from the DC power supply is a DC current and the alternating current power from the AC power supply is an AC voltage.

17. The image transfer device according to claim 12, wherein the one of the transfer members defining the first electrode comprises a backup roller contacting a surface opposite the image bearing surface of the image bearing member, and the other one of the transfer members defining the third electrode comprises a nip roller contacting the image bearing surface of the image bearing member.

18. The image transfer device according to claim 12, wherein the one of the transfer members defining the first electrode comprises a nip roller contacting the image bearing surface of the image bearing member, and the other one of the transfer members defining the third electrode comprises a backup roller contacting a surface opposite the image bearing surface of the image bearing member.

19. The image transfer device according to claim 1, wherein the electrical bias applicator connects the single power supply to supply one of the at least one component and the second electrical bias without simultaneously supplying the other of the at least one component and the second electrical bias.

20. An image transfer device for transferring a toner image from an image bearing member defining an image bearing surface on which the toner image is created, the image transfer device comprising:

a transfer member disposed opposite the image bearing member to form a transfer nip therebetween through which a recording medium is passed, the transfer member defining a first electrode to which a first electrical bias is applied to electrostatically transfer the toner image from the image bearing surface to the recording medium across the transfer nip;

a media separator defining a second electrode downstream from the transfer nip to which a second electrical bias is applied to separate the recording medium from the image bearing surface after exiting the transfer nip; and an electrical bias applicator including a single power supply that connects with the first electrode to supply at least one component of the first electrical bias to the first electrode and connects to the second electrode to supply the second electrical bias to the second electrode.

21. An image forming apparatus comprising:

means for defining an image bearing surface on which a toner image is created;

means for forming a transfer nip through which a recording medium is passed while pressed against the image bearing surface;

a first electrode, disposed facing the transfer nip, to which a first electrical bias is applied to electrostatically transfer the toner image from the image bearing surface to the recording medium;

a second electrode, disposed downstream from the transfer nip, to which a second electrical bias is applied to separate the recording medium from the image bearing surface after exiting the transfer nip; and an electrical bias applicator including a single power supply that connects with the first electrode to supply at least one component of the first electrical bias to the first electrode and connects to the second electrode to supply the second electrical bias to the second electrode.

* * * * *